US006588898B2

(12) United States Patent
Iwai et al.

(10) Patent No.: US 6,588,898 B2
(45) Date of Patent: Jul. 8, 2003

(54) APPARATUS FOR DISPLAYING LENS CONTOUR, APPARATUS FOR PROCESSING LENS CONTOUR DATA, AND APPARATUS FOR GRINDING EDGE OF EYEGLASS LENS WITH THE SAME

(75) Inventors: Toshihiro Iwai, Tokyo (JP); Tatsuro Yokoi, Tokyo (JP); Takeshi Nakamura, Tokyo (JP); Yoshiyuki Hatano, Tokyo (JP); Yasuo Suzuki, Tokyo (JP)

(73) Assignee: Kabushiki Kaisha Topcon, Tokyo (JP)

( * ) Notice: Subject to any disclaimer, the term of this patent is extended or adjusted under 35 U.S.C. 154(b) by 43 days.

(21) Appl. No.: 09/775,203

(22) Filed: Feb. 1, 2001

(65) Prior Publication Data

US 2001/0035933 A1 Nov. 1, 2001

(30) Foreign Application Priority Data

| | | |
|---|---|---|
| Feb. 1, 2000 | (JP) | 2000-024533 |
| Feb. 14, 2000 | (JP) | 2000-035418 |
| Mar. 10, 2000 | (JP) | 2000-066881 |

(51) Int. Cl.[7] ..... G02C 7/02
(52) U.S. Cl. ..... 351/159; 351/158; 351/178
(58) Field of Search ..... 351/158, 178, 351/159, 174, 177, 83, 85; 451/41–43, 240, 390

(56) References Cited

U.S. PATENT DOCUMENTS

| | | | | |
|---|---|---|---|---|
| 5,450,335 A | * | 9/1995 | Kikuchi | 364/560 |
| 5,926,247 A | * | 7/1999 | Kimura | 351/41 |
| 6,336,057 B1 | * | 1/2002 | Obayashi | 700/164 |

FOREIGN PATENT DOCUMENTS

| | | | |
|---|---|---|---|
| JP | 61-274859 | 12/1986 | B24B/9/14 |
| JP | 02-212059 | 8/1990 | B24B/9/14 |
| JP | 03-135710 | 6/1991 | G01B/21/20 |
| JP | 04-146067 | 5/1992 | B24B/9/14 |
| JP | 5-111866 | 5/1993 | B24B/9/14 |
| JP | 8-287139 | 11/1996 | G06F/17/50 |
| JP | 10-156685 | 6/1998 | B24B/9/14 |

* cited by examiner

*Primary Examiner*—Jordan M. Schwartz
(74) *Attorney, Agent, or Firm*—Chapman and Cutler

(57) ABSTRACT

The present invention provides an apparatus for displaying lens contour, an apparatus for processing lens contour data, and apparatus for grinding edge of eyeglass lens with the same so that these apparatuses can grasp contours of the eyeglass frame and the eyeglass lens related to three dimensional virtual display (3D V-shaped simulation), and a V-shaped figure formed in an edge surface of lens in three dimensions to represent visually assembling of the virtual frame. These apparatuses comprises, an input means 1 of lens rim contour data for inputting left/right lens rim contour data of an eyeglass frame MF in three dimensions; a calculating/determining circuit 91 for calculating, based on the inputted lens rim contour data, an angle of inclination of lens rim contour of either left or right eye of the eyeglass frame to lens rim of the other eye; and a liquid crystal display panel 62 for displaying a type of inclination of left/right lens rims of the eyeglass frame, based on the calculated results, as side view from upper or lower side of the eyeglass frame.

16 Claims, 29 Drawing Sheets

16
17
18
19
20
20a
20b
21
22
23
23a
24
25
26
27
30
31
32
33
33a
33b
34
35
36
37
38
39
41
42
42a
42b
42c
43
44
44a
45
46
46a
47
S
a

Tilt: Tilt the V-shape by inputting the tilt amount

Whole: Move the whole of the V-shape by a constant amount (a) Input of the tilt amount The V-shape is tilted in a desired position by fitting the cursor to the item "Tilt" by the "+", "-" switches and inputting the forward and backward moving amount of the V-shape (a) Adjustment of the whole position Change the item into the item "Whole" by pushing the input change switch, in a state that the cursor is fitted to the item "Tilt"

Adjust the V-shape position by means of the "+", "-" switches

FIG.24(a)
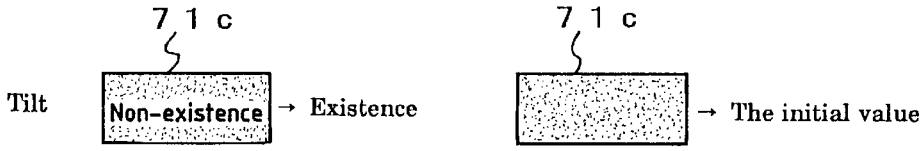
FIG.24(b)
Change screen of the initial setting
62
| Switch | | Display screen | | Size set |
|---|---|---|---|---|
| Lens | Non-existence | ←B→ | 15.0 | |
| Course | Auto | PD | 64.0 | |
| Frame | Metal | UP | +2.0 | |
| Auto-test | Non-existence | Center height | Hlp | |
| Beep sound | Non-existence | AXS | Non-existence | |
| Tilt | Existence | V-shape | DF | |
| | | φ | Non-existence | |
| | | Optyl | Non-existence | |
| | | Layout | Optical center | |
71b
FIG.25(a)
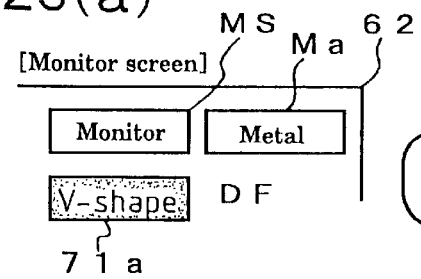
FIG.25(b)
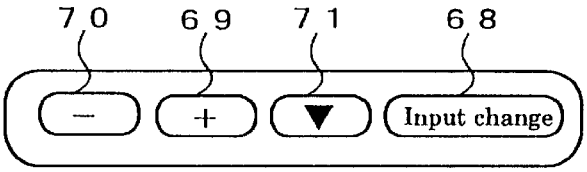
FIG.25(c)
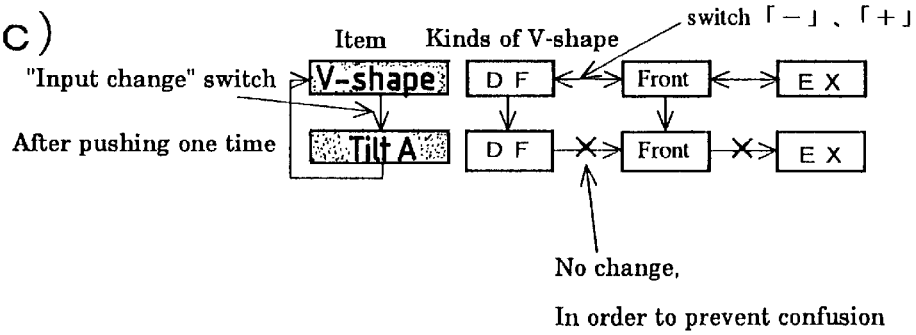

* The tilt reference axis passes through eye point

Tilt axis: Set the tilt reference axis

Tilt: Tilt the V-shape by inputting the tilt amount

Whole: Move the whole of the V-shape by a constant amount (a) A desired tilt reference axis is set by fitting the cursor to the item "Tilt axis" and changing an angle value with the "+", "-" switches The tilt reference axis can be set every 5° at the whole circumference (a): In the state that the cursor is set to the item "Tilt axis", input change switch is pushed to change the item to "Tilt"

The V-shape is tilted in a desired position by inputting forward and backward moving amount of the V-shape by the "+" and "-" switches (a): In the state that the cursor is set to the item "Tilt", input change switch is pushed to change the item to "Whole".

The "+" and "-" switches is used to adjust the V-shaped position

Ratio V-shape tilt

Calculate the spherical surface curve at four points on the V-shape obtained with the ratio

APPARATUS FOR DISPLAYING LENS CONTOUR, APPARATUS FOR PROCESSING LENS CONTOUR DATA, AND APPARATUS FOR GRINDING EDGE OF EYEGLASS LENS WITH THE SAME

TECHNICAL FIELD

The present invention relates to an apparatus or displaying lens contour, an apparatus for processing lens contour data, and apparatus for grinding edge of eyeglass lens with the same. Particularly, the present invention relates to the apparatus for displaying a V-shaped figure formed in an edge end surface of eyeglass lens, after finish grinding (or after ground by a finishing grinder or edger), to be assembled in a lens rim of an eyeglass frame.

BACKGROUND OF THE INVENTION

Conventionally, there are known various apparatuses, that is, an apparatus for displaying a contour of lens, an apparatus for processing a contour data of lens, and apparatus for grinding edge of eyeglass lens with the same, in which are related to a simulation and its calculating processing in assembling an lens contour of eyeglass lens and the eyeglass lens in an eyeglass frame after finish grinding (for example, as disclosed in Japanese Laid-Open Patent Application Nos. sho 61-274859, hei 2-212059, hei 3-135710, hei 4-146067, hei 5-111866, hei 8-287139, hei 10-156685, etc.).

In the prior arts, however, the apparatus for displaying a contour of lens, the apparatus for processing a contour data of lens, and the apparatus for grinding edge of eyeglass lens with the same are not provided so that these apparatuses can grasp the contour of the eyeglass frame and the eyeglass lens related to three dimensional virtual display, and a V-shaped figure formed in an edge surface of lens in three dimensions to represent visually assembling of the virtual frame.

SUMMARY OF THE INVENTION

It is therefore an object of the present invention to provide an apparatus for displaying a contour of lens, an apparatus for processing a contour data of lens, and an apparatus for grinding edge of eyeglass lens with the same so that these apparatuses can grasp the contours of the eyeglass frame and the eyeglass lens related to three dimensional virus display (3D V-shaped simulation), and a V-shaped figure formed in an edge surface of lens in three dimensions to represent visually assembling of the virtual frame.

In addition, conventionally, when eyeglass lens is assembled in an eyeglass frame, V-shaped figure (V-shaped locus) is formed in periphery edge (also called 'edge end surface') of eyeglass lens such that it can be fit with a frame groove (also called 'V-shaped groove' or 'rim groove'), but when forming a V-shaped figure (V-shaped contour), a method forming V-shape with ratio of the periphery edge or a method forming V-shape with V-shaped curve according to a frame curve has been adopted.

However, since any of the both methods calculates V-shaped contour based on edge thickness data at the optionally limited number of positions in edge contour and frame figure data at the limited number of positions in the eyeglass frame, there are some theoretical problems for eyeglass lens to completely fit V-shaped groove of an eyeglass frame. So, V-shaped contour has been tilted with reference to a minimum edge position.

But, in such a tilt V-shaped method with reference to a minimum edge position, as shown in FIG. 34, since the V-shaped contour, that is, a V-shaped groove in an eyeglass frame is arithmetically processed as a contour on a curve surface formed in some spherical surfaces and the contour is tilted by predetermined amount, there are some probabilities that the V-shaped contour deviates from the edge surface in an accumulated multi-focus lens in which an edge thickness varies continuously or an EX lens in which an edge thickness varies discretely, and thereby there have been many cases in which eyeglass lens after final process did not fit a frame groove (V-shaped groove) in an eyeglass frame.

It is therefore the second object of the invention to provide an apparatus for processing lens contour data and an apparatus for grinding edge of eyeglass lens, improving the conventional V-shaped method, in which the V-shaped contour is tilted by predetermined amount, with reference to a minimum edge position, thereby, setting, as a reference line of a desired incline direction, a straight line perpendicular to line which connects any edge position of the lens rim with an edge position having a relation of point symmetry to a pupil center of an eyeglass wearer's eye for the edge position, obtaining a V-shaped figure data for correction formed in the edge end surface of the eyeglass lens to be inclined desirably with the reference line in the center, and inclining desirably the V-shaped figure data to grind edge of eyeglass lens.

To achieve the objects, an embodiment in accordance with the invention is characterized in that an apparatus for displaying lens contour comprises an input means of lens rim contour data for inputting left/right lens rim contour data of an eyeglass frame in three dimension; a calculating means for calculating, based on the inputted lens rim contour data, an angle of inclination of lens rim contour in either left or right eye of the eyeglass frame to lens rim of the other eye; and a display means for displaying a type of inclination of left/right lens rims of an eyeglass frame, based on the calculated angle, as a view from upper or lower side of the eyeglass frame.

One aspect of the invention is characterized in that, in an apparatus for displaying lens contour, a side view of the eyeglass lens assembled in the lens rim of the eyeglass frame after finish grinding, is displayed corresponding with the type of inclination of the left/right lens rim eyeglass frame in the same screen as upper side or lower side view of the eyeglass frame.

Another aspect of the invention is characterized in that, in the above apparatus for displaying lens contour, the apparatus represents a direction of eye in a state of long distance based on pupil distance (PD) data of the eyeglass wearer.

Other aspect of the invention is characterized in that, in the above apparatus for displaying lens contour, the apparatus represents an optical axis direction of eyeglass lens assembled in the lens rim of the eyeglass frame.

Other aspect of the invention is characterized in that, in the above apparatus for displaying lens contour, the apparatus displays a front view of the lens rim contour data of the eyeglass frame in the same pictures.

Other aspect of the invention is characterized in that, in the above apparatus for displaying lens contour, the apparatus displays a cross side view of the eyeglass lens assembled in the eyeglass frame in the same pictures.

Other aspect of the invention is characterized in that, in the above apparatus for displaying lens contour, the apparatus displays an inclined angle of the lens rim of the eyeglass frame.

Other aspect of the invention is characterized in that, in the above apparatus for display lens contour, the apparatus displays an inclined angle of the optical axis of the eyeglass lens to a pupil center of eye of the eyeglass wearer.

Also, in order to achieve the objects, still another aspect of the invention is characterized in that an apparatus for processing lens contour data comprises a lens rim contour data input means for inputting a lens rim contour data of an eyeglass frame in three dimensions; an edge thickness contour data input means for inputting an edge thickness contour data of eyeglass lens to be assembled in a lens rim; a V-shaped figure data input means for inputting a V-shaped figure data related to V-shaped figure formed in an edge end surface of the eyeglass lens; and a calculating means for calculating an angle of inclination of an optical axis of the eyeglass lens to a pupil center of the eyeglass wearer's eye after finish grinding as calculated, based on the inputted edge thickness contour data and the V-shaped figure data.

Other aspect of the invention is characterized in that, an apparatus comprising the apparatus for processing lens contour data, the apparatus further comprises a display means or displaying the calculated angle of inclination of the optical as of the eyeglass lens to the pupil center of the eyeglass wearer's eye.

Other aspect of the invention is characterized in that, in the above apparatus for processing lens contour data, the apparatus further comprises a display means for displaying the angle of inclination of the optical axis of the eyeglass lens to the pupil center of the eyeglass wearer's eye.

Also, so as to achieve the above-mentioned objects, still another aspect of the invention is characterized in that an apparatus for processing lens contour data comprises lens rim contour data input means for inputting a lens rim contour data of an eyeglass frame in three dimensions; an edge thickness contour data input means or inputting an edge thickness contour data of eyeglass lens to be assembled in a lens rim; a V-shaped figure data input means for inputting a V-shaped figure data related to V-shaped figure formed in an edge end surface of the eyeglass lens; and a calculating means for setting, as a reference line of a desired incline direction, a straight line perpendicular to line which connects any edge position of the lens rim with an edge position having a relation of point symmetry to a pupil center of an eyeglass wearer's eye for the edge position, obtaining a V-shaped figure data for correction formed in the edge end surface of the eyeglass lens to be inclined desirably with the reference line in the center.

Further, in order to achieve the above objects, other aspect of the invention is characterized in that an apparatus displays a line connecting any edge position of a lens rim with an edge position having a relation of point symmetry to a pupil center of an eyeglass wearer's eye for the edge position to overlap in the lens rim contour.

BRIEF DESCRIPTION OF THE DRAWINGS

FIGS. 5(*b*) and 5(*c*) are sectional views for explaining a relationship between a cylindrical shaft of FIG. 5(*a*) and an operation shaft.

FIG. 5(*d*) is a view for explaining a holding claw.

FIG. 16(*b*) is a view for explaining the screen changing the initial setting of the liquid crystal panel.

FIG. 17(*c*) is a view for explaining a keyboard.

FIG. 22(*b*) is a view for explaining another example of the tilt screen of the liquid crystal panel.

FIG. 23(*b*) is a view for explaining another example of the tilt screen of the liquid crystal panel.

FIG. 24(*a*) is a view for explaining a portion of the screen changing the initial setting of the liquid crystal panel shown in FIG. 24(*b*).

FIG. 24(*b*) is a view for explaining the screen changing the initial setting of the liquid crystal panel.

FIG. 25(*a*) is a view for explaining a liquid crystal panel.

FIG. 25(*b*) is a view for explaining a portion of the keyboard for changing input.

FIG. 25(*c*) is a view for explaining the change of input.

FIG. 30(*b*) is a view for explaining another example of the tilt screen of the liquid crystal panel.

FIG. 31(*b*) is a view for explaining another example of the tilt screen of the liquid crystal panel.

FIG. 32(*b*) is a view for explaining another example of the tilt screen of the liquid crystal panel.

DETAILED DESCRIPTION OF THE INVENTION

An embodiment of an apparatus for displaying fitness determination of eyeglass lens according to the present invention will be described with reference to the attached drawings.

Figure 2:
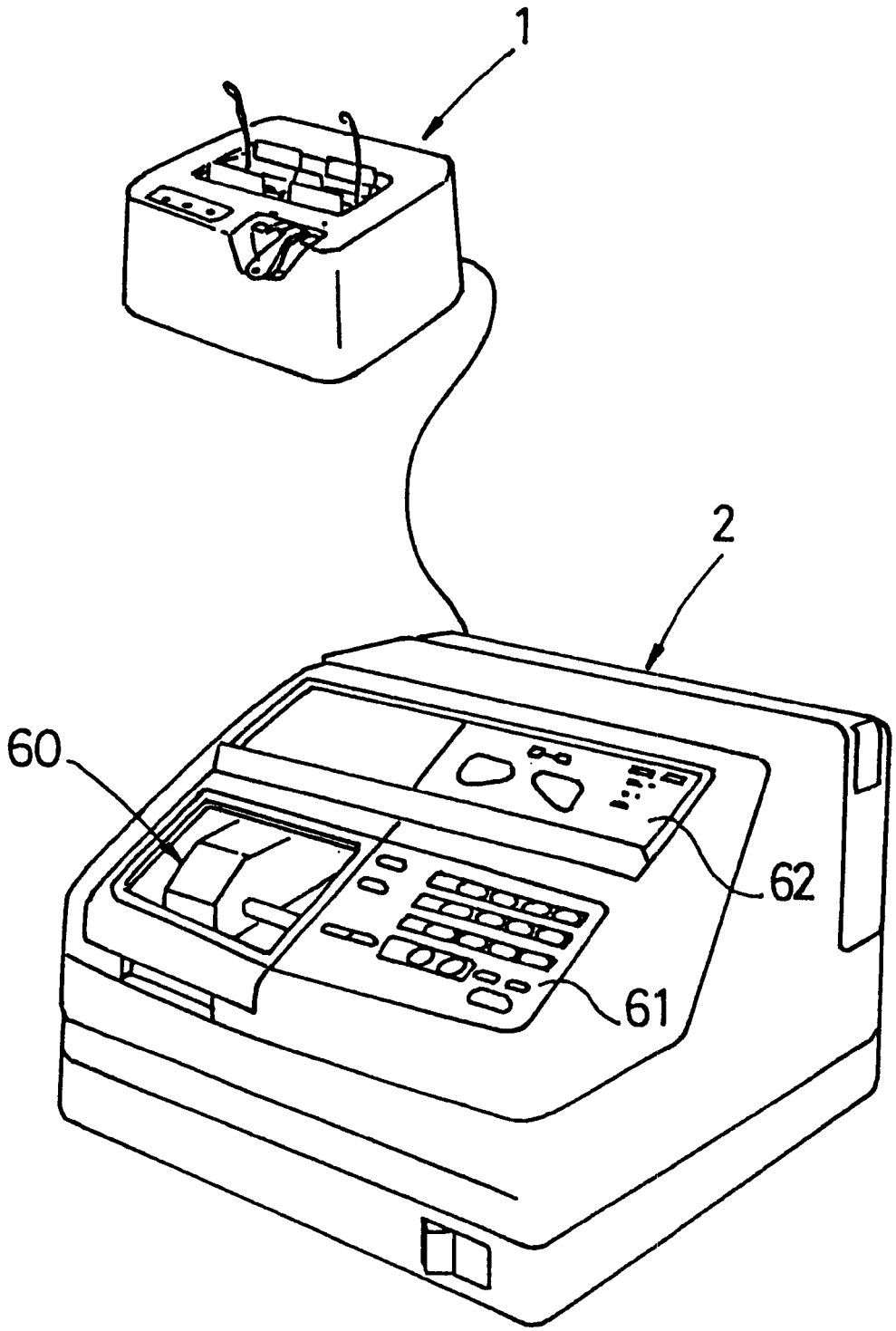
FIG. 2 is a schematic perspective view of the apparatus for determining fitness of the eyeglass lens provided with the control circuit shown in FIG. 1.

In FIG. 2, reference numeral 1 denotes a frame contour measuring apparatus and reference 2 denotes lens grinding apparatus (lens edging apparatus) for grinding and shaping an uncut lens into a finished eyeglass lens, based on eyeglass-contour data obtained from the same contour measuring apparatus 1.

(1) Frame Contour Measuring Apparatus 1

Figure 4:
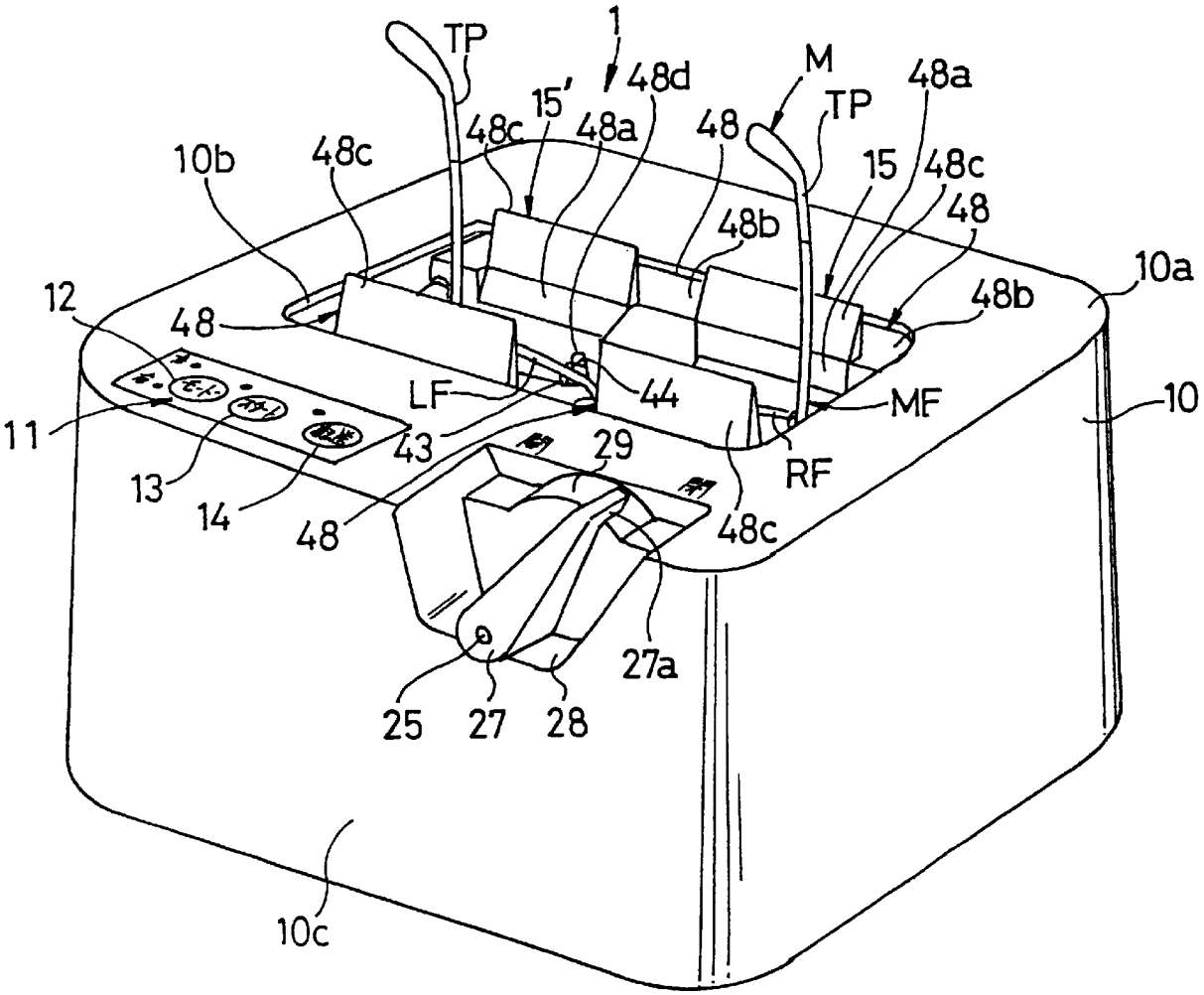
FIG. 4 is an enlarged perspective view of a frame contour measuring apparatus shown in FIG. 2.

As shown in FIG. 4, the frame contour measuring apparatus 1 (lens rim contour data input means) comprises an apparatus body 10 having an opening 10*b* in the middle of an upper surface 10*a* and a switch portion 11 mounted on the upper surface 10*a*of the body 10. The switch portion 11 includes a mode changing switch 12 for changing over right and left measurement modes, a start switch 13 for staring measurement and a transfer switch 14 for transferring data.

Figures 5A, 5B, 5C, 5D:
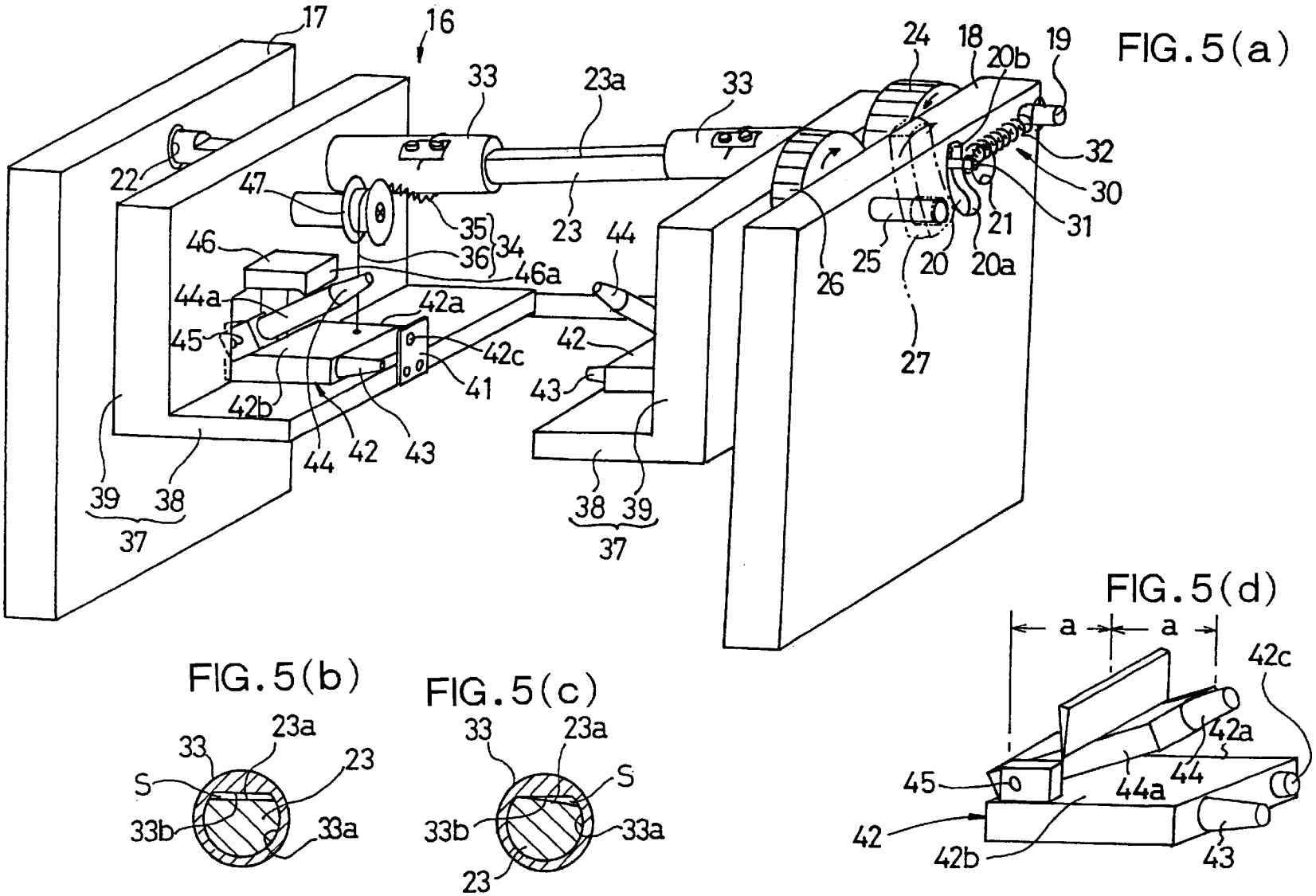
FIG. 5(*a*) is a perspective view of a main portion of the frame contour measuring apparatus shown in FIGS. 2 and 4.
Figure 7A:
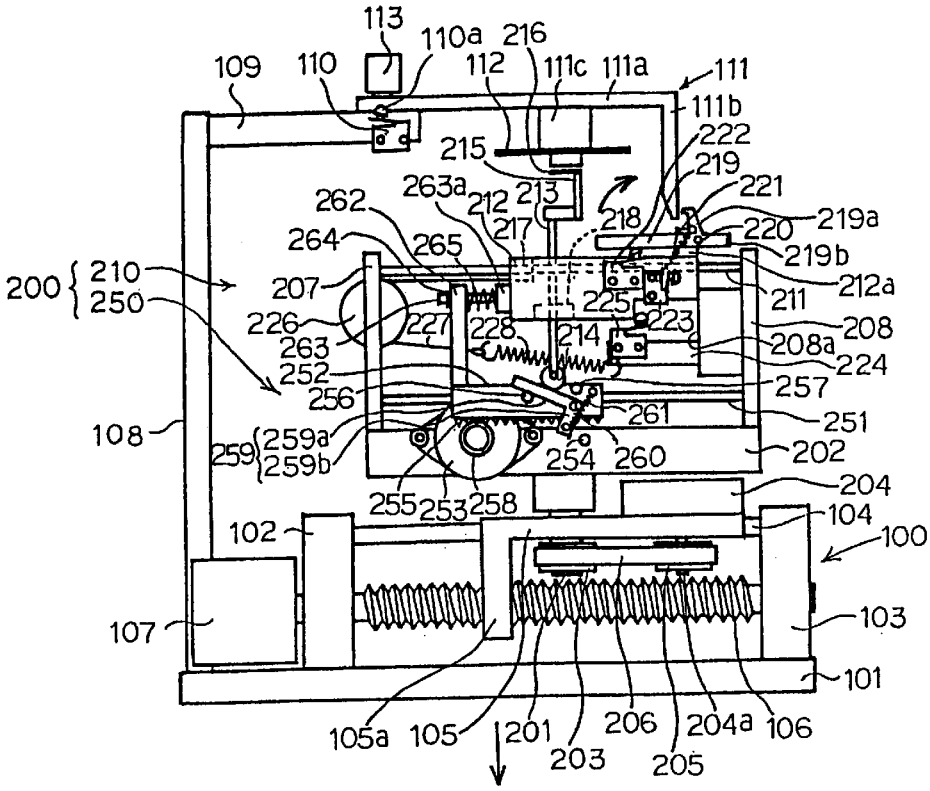
FIGS. 7(*a*) and 7(*b*) are views for explaining a frame contour meaning section, etc. of the frame contour measuring apparatus.
Figure 7B:
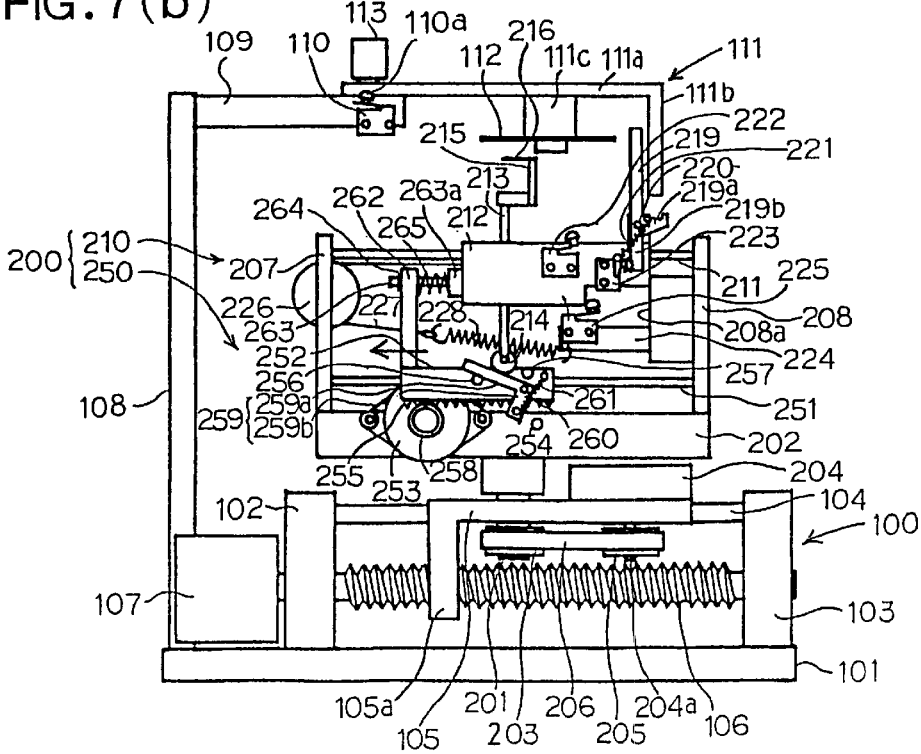

The frame contour measuring apparatus 1 further comprises eyeglass frame holding mechanisms 15, 15' for holding right and left lens rims LF, RF of an eyeglass frame MF of an eyeglass M as shown in FIG. 4, an operation mechanism 16 (see FIG. 5(*a*)), a measurement portion moving mechanism 100 as shown in FIG. 7, and a frame contour measurement portion (frame contour measuring means) 200 supported by the measurement portion moving mechanism 100.

The measurement portion moving mechanism 100 moves the frame contour measurement portion 200 between the eyeglass frame holding mechanisms 15 and 15'. The frame contour measurement portion 200 measures the contour of the eyeglass frame MF, that is, the contour of the lens rim LF (RF) thereof. The eyeglass frame holding mechanisms 15, 15', the operation mechanism 16, the measurement portion moving mechanism 100 and the frame contour measurement portion 200 are mounted within the apparatus body 10.

In FIG. 7, reference numeral 101 denotes a chassis disposed on a lower part of the body 10. In FIG. 5, reference numerals 17 and 18 denote supporters mounted in parallel to each other and fixed upward and downward at position which is not shown in the chassis 101, reference numeral 19 denotes an engagement pin projecting from an outside surface (opposite to the supporter 17) of the supporter 18, reference numeral 20 denotes a circular slit mounted on an upper end portion of the supporter 18, reference numerals 21 and 22 denote mounting holes formed in the supporters 17 and 18, respectively. The mounting hole 22 is formed between the circular slit 20 and the engagement pin 19. The circular slit 20 is concentric with the mounting hole 22.

(Operation mechanism 16)

The operation mechanism 16 comprises an operation shaft 23 rotatably held in the mounting holes 21, 22 of the supporters 17 and 18, a driven gear 24 fixed to an end portion on the side of the supporter 18 of the operation shaft 23, a rotation shaft 25 passing through the supporter 18 and a front surface 10*c* of the body 10, a driving gear 26 fixed to an end portion of the rotation shaft 25 (or formed integrally with the rotation shaft 25) and engaged with the driven gear 24, and an operation lever 27 mounted on the other end portion of the rotation shaft 25. Reference numeral 23*a* denotes a flat portion formed on the operation shaft 23 and extending close to the two end portions of the operation shaft 23.

In the apparatus body 10, a concave portion 28 is formed extending from the front surface 10*c* to the upper surface 10*a*, and a circular projection 29 is formed on the upper surface of the concave portion 28. Signs "ON" and "OFF" are provided on the upper surface 10*a* and are positioned on right and left sides of the projection 29, respectively. The operation lever 27 as described above is disposed on a front surface of the concave portion 28, and a curved portion, namely, instruction portion 27*a* is mounted on an upper portion of the operation lever 27 to be movable on the projection 29.

Between the driven gear 24 and the engagement pin 19, a two-position holding mechanism 30 (two-positions holding means) is mounted for holding the frame (corresponding to the sign "ON") and releasing the frame from being held (corresponding to the sign "OFF").

The two-position holding mechanism 30 comprises the circular slit 20, a movable pin 31 projecting from a side surface of the driven gear 24 and passing through the circular slit 20, and a spring 32 (tension coil spring arranged between the movable pin 31 and the engagement pin 19. Since the circular slit 20 is concentric with the mounting hole 22 as mentioned above, the driven gear 24 and the operation shaft 23 are also concentric with each other. For this reason, the movable pin 31 is held by one of two end portions 20*a* and 20*b* of the circular slit 20 by the tension force of the spring 32.

The operation mechanism 16 further comprises a pair of cylindrical shafts 33, 33' to be movable in a length direction of the operation shaft 23 and to be supported for slightly relative rotation in a circumferential direction. Between a flat portion 33*b* of a cut-circular through-hole 33*a* of the cylindrical shaft 33 and the flat portion 23*a* of the operation shaft 23, a slight space S is formed as shown in FIGS. 5(*b*) and 5(*c*). In the cylindrical shafts 33, 33', string-like bodies 34 (only one is shown in FIG. 5(*a*)) are mounted each of which includes an elastic portion because of its own elastic force. The string-like body 34 comprises a spring 35 (elastic portion) of which an end portion is fixed to the cylindrical shaft 33, and a wire 36 connected to the other end portion of the spring 35.

(Frame holding mechanisms 15, 15')

The frame holding mechanisms 15, 15' are the same in structure, and therefore only the frame holding mechanism 15 will be described.

The frame holding mechanism 15 comprises a pair of movable supporters 37, 37 as sliders held in the apparatus body 10 which are movable in a horizontal direction and are movable close to (or away from) each other. Each of the movable supporters 37, 37 is shaped like "L" which consists of a horizontal plate portion 38 and a vertical plate portion 39 which vertically extends from an end portion of the horizontal plate portion 38. In the vertical plate portion 39, the cylindrical shaft 33 is held rotatably but cannot be moved in an axial direction.

Figure 6A:
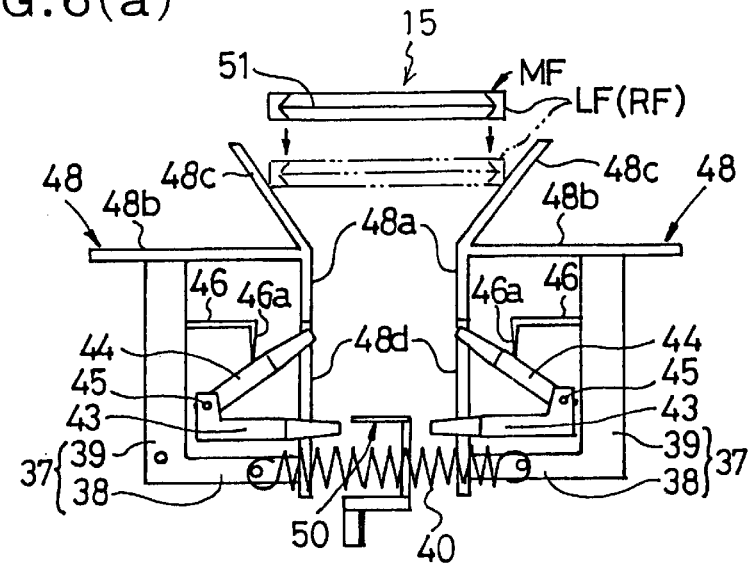
FIGS. 6(*a*) to 6(*c*) are views for explaining an eyeglass frame holding operation of the frame contour measuring apparatus shown in FIGS. 2, 4 and 5.
Figure 6B:
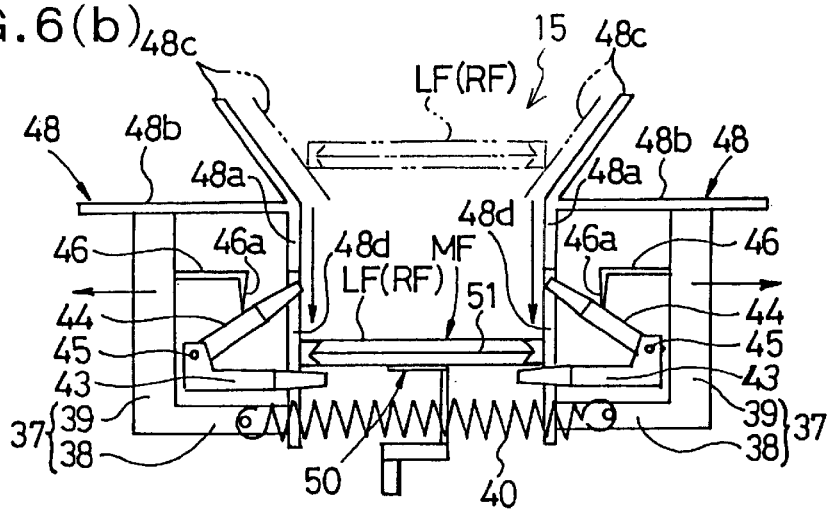
Figure 6C:
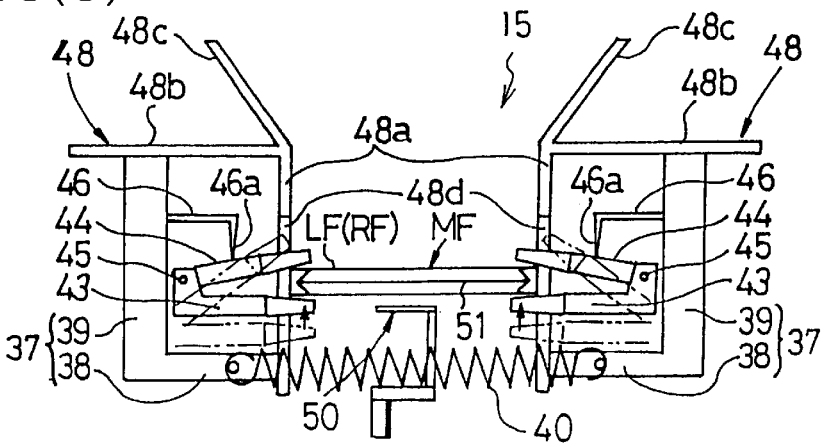

The frame holding mechanism 15 further comprises a tension coil spring 40 which is arranged between the horizontal plate portions 38, 38 of the movable supporters 37, 37 as shown in FIG. 6, a supporting plate 41 fixed in the center of a periphery edge at a front end of the horizontal plate portion 38, and a claw mounting plate 42 disposed between the vertical plate portion 39 and a part of the supporting plate 41 which projects from the upward side of the horizontal plate portion 38. The claw mounting plate 42 is supported by both the supporting plate 41 and the vertical plate portion 39 so as to be rotatable centering a shaft-shaped supporting projection 42*c* of a side portion 42*a*. The shaft-shaped supporting projection of a rear side portion of the claw mounting plate 42 is not shown.

A shaft-shaped tapered holding claw 43 projects from a front end of the other side portion 42*b* of the claw mounting plate 42, and a rear end portion of a shaft-shaped holding claw 44 is supported rotatably by a supporting shaft 45 on a rear end of the other side portion of the claw mounting plate 42. The holding claw 44, of which a base portion 44*a* is shaped like a square plate as shown in FIG. 5(*d*) and the front end portion is tapered, is rotatable with the supporting shaft 45 in the center, and is allowed to relatively approach the holding claw 43 or recede therefrom. Additionally, the front end portion of the holding claw 44 and the claw mounting plate 42 are spring-urged to be always opened by a torn spring (not shown) wound on the supporting shaft 45.

In the vertical plate portion 39, a "L"-shaped engagement claw 46 is projected therefrom, and is positioned in the upper side of the holding claw 44. An edge-shaped claw portion 46*a* of a front end portion of the engagement claw 46 which extends downward is engaged with the holding claw 44. Thus, when the other side portion 42*b* of the claw mounting plate 42 is rotated upward centering the side portion 42*a*, a space between the holding claws 43 and 44 is narrowed against the elastic force of the torsion spring (not shown). As shown in FIG. 5(*d*), the edge-shaped claw portion 46*a* of the engagement claw 46 is engaged with approximately a middle portion of the holding claw 44. An idle pulley 47, which is rotatably attached to the vertical plate portion 39, is mounted between the engagement claw 46 and the cylindric shaft 33. The above-mentioned wire 36 is put on the idle pulley 47, and an end portion of the wire 36 is situated between the two side portions 42*a* and 42*b*, and is fixed to the claw mounting plate 42. The movable supporters 37, 37 have two opposite sides which are covered with a frame guide member 48 shown in FIG. 4 and FIG. 6. The frame guide member 48 comprises a vertical plate portion 48*a* fixed to a front end of the horizontal plate portion 38, a horizontal plate portion 48*b* fixed to an upper end of the vertical plate portion 39, and an inclined guide plate portion 48*c* coded to a corner, at which the plate portions 48*a* and 48*b* are connected to each other and inclining to the horizontal plate portion 48*b*. In the vertical plate portion 48*a*, an aperture 48*d* is formed corresponding to the holding claws 43 and 44, and the holding claw 44 projects from the aperture 48*d*. The front end portion of the holding claw 43 is to be positioned within the aperture 48*d* in an open state in which the holding claws 44 and 43 are widened at its maximum, as shown in FIGS. 6(*a*) and 6(*b*).

In this construction, the inclined guide plates 48*c*, 48*c* of the frame guide members 48, 48 are inclined in a direction in which the distance between the guide plates 48*c*, 48*c* is gradually widened upward. Accordingly, when the eyeglass frame MF is placed between the inclined guide plates 48*c*, 48*c*, as shown in FIG. 6(*a*), and is pushed down against the elastic force of the coil spring 40, a space between the frame guide members 48, 48 is widened by means of the inclined guide plates 48*c*, 48*c*, and the eyeglass frame MF, that is, the lens rim LF(RF) of the eyeglass frame MF is moved to be engaged with the holding claws 43, 43.

In this state, when the operation lever 27 is operated to be rotated from the position "OFF" to the position "ON", this rotation movement is transferred to the cylindrical shaft 33 via the rotation shaft 25, the gears 26, 24, and the operation shaft 23, and thereby part of the spring 35 is wound on the cylindrical shaft 33 so that via the wire 36 contacted with the spring 35, the claw mounting plate 42 is rotated upward centering the side portion 42*a*, the space of the holding claws 43, 44 is then narrowed as shown in FIG. 6(*c*), and, as a result, the lens rim LF(RF) of the eyeglass frame MF is held between the holding claws 43, 44 as shown in FIG. 6(*c*). In this position, the movable pin 31 is held on the lower end portion 20*a* of the circular slit 20 by the elastic force of the spring 32.

In order to remove the lens rim LF(RF) of the eyeglass frame MF from the holding claws 43, 44, the operation lever 27 is operated conversely to the aforementioned operation so that the members are conversely actuated.

(Measurement portion moving mechanism 100)

Figure 8A:
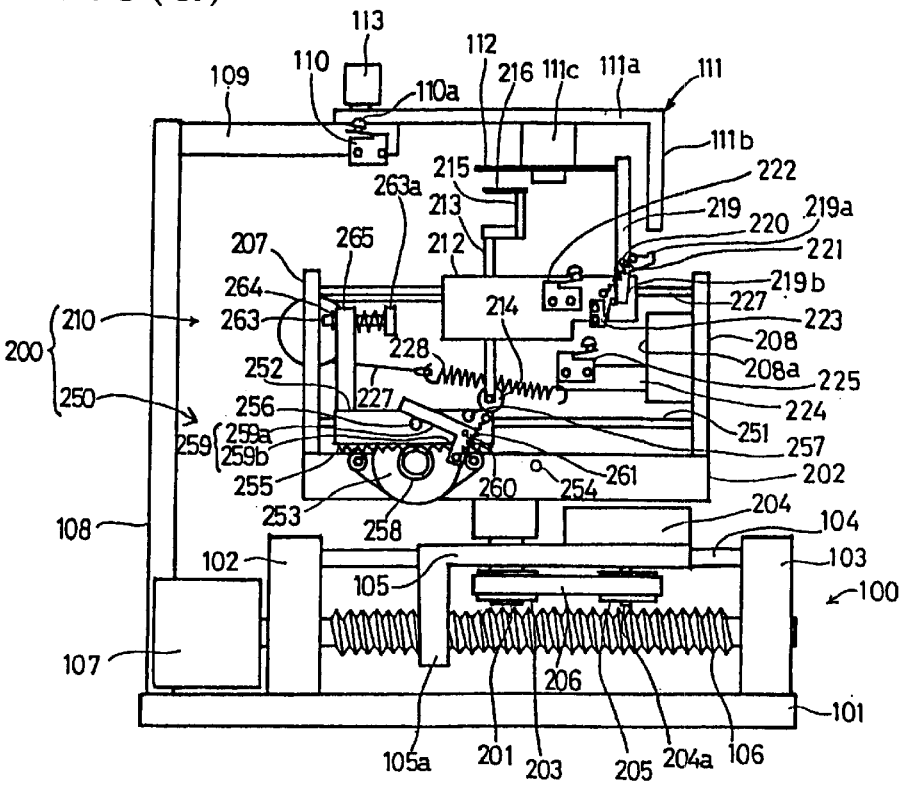
FIGS. 8(*a*) and 8(*b*) are views for explaining a frame contour measuring section, etc. of the frame contour measuring apparatus.
Figure 8B:
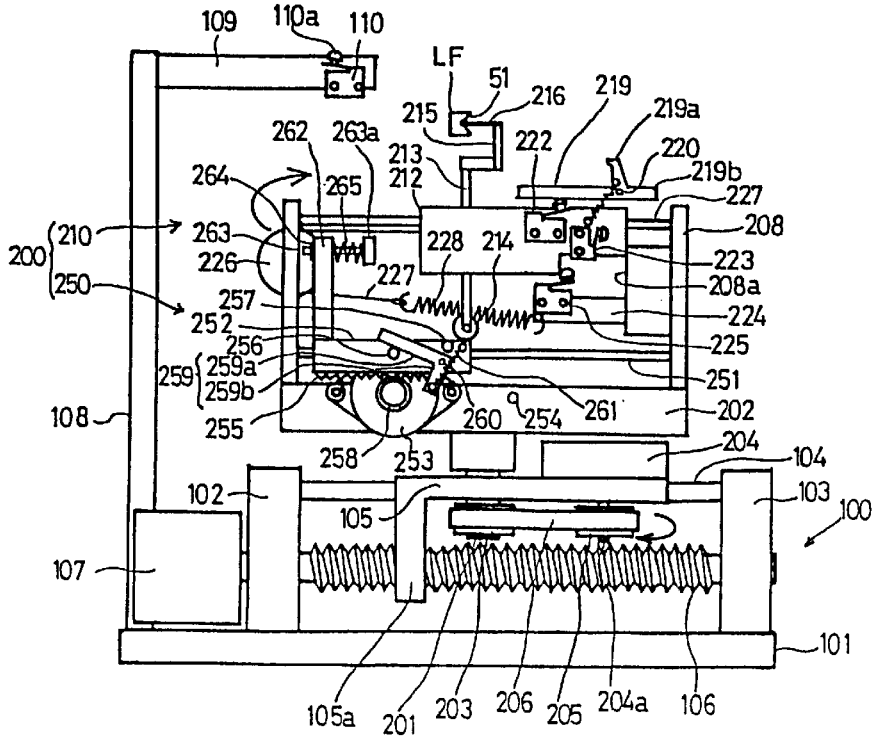

The measurement portion moving mechanism 100 comprises supporting plates 102, 103 which are fixed to the chassis 101 and are spaced in a direction where the frame holding mechanisms 15, 15' are arranged, and a guide rail 104 stretched between the upper parts of the supporting plates 102, 103. The guide rail 104 stretched therebetween is two in number, but the other one is not shown. The two guide rails 104 are arranged in parallel with each other in a direction perpendicular to the figure (i.e., to the drawing sheet). FIG. 7 and FIG. 8 show schematically the measurement portion moving mechanism of FIG. 4.

The measurement portion moving mechanism 100 further comprises a slide base 105 which is held on the guide rails 104 (only one is shown) to be freely movable in an extending direction of the guide rails 104, a feed screw 106 which is under the guide rails 104 (only one is shown) to be rotatable around the supporting plates 102, 103, and a measurement portion moving motor 107 which drives and rotates the feed screw 106.

The feed screw 106 is placed in parallel to the guide rail 104, and the measurement portion moving motor 107 is fixed to the chassis 101. The vertical plate portion 105*a* extending downward is formed integrally with the slide base 105, and the feed screw 106 is screwed to a female-screw portion (not shown) of the vertical plate portion 105*a*. Thus, the slide base 105 can be operated to be moved left and right in FIG. 7 by rotating the feed screw 106.

In FIG. 7, reference numeral 108 denotes a supporting plate which is fixed to a left end of the chassis 101 and extends up and down, reference numeral 109 denotes a holder supporting piece fixed to the left of an upper end of the supporting plate 108, and reference numeral 110 denotes a micro-switch (sensor) which is mounted on a side surface of a front end portion of the holder supporting piece 109. The micro-switch 110 is used to detect lens rim holder 111 which holds lens-shaped template, such as a demonstration lens, and a template formed in the frame rim contour (lens-shaped contour). The micro-switch 110 may be mounted on the supporter 17 or 18 of FIG. 5, and the micro-switch 110 may detect the lens rim holder 111 by the contact with the movable supporters 37, 37 when the holding claws 43, 44 hold the lens rim holder 111.

The lens rim holder 111 is shaped like "L" in section from lens shaped template holding plate portion 111*a* and a template filler erecting plate portion 111*b* connected downwardly with an end portion of the lens shaped template holding plate portion 111*a*. A lens shaped template holding boss portion 111*c* is formed integrally with the lens shaped template holding plate portion 111*a* and holds lens rim 112.

In FIG. 7, reference numeral 113 denotes a fixing-screw attached to the other end of the lens shaped template holding plate portion 111*a*. When the lens shaped template holding plate portion 111*a* is fixed to the front end portion of the holder supporting piece 109 by means of the screw 113, the lens shaped template holding plate portion 111*a* is brought into contact with a sensor lever 110*a* of the micro-switch 110, and thereby it is detected that the lens rim 112 is in a measurable state.

(Frame contour measurement portion 200)

The frame contour measurement portion 200 shown in FIG. 7 comprises a rotation shaft 201 which passes through and is rotatably supported to the slide base 105, a rotation base 202 mounted on an upper end portion of the rotation shaft 201, a timing gear 203 fixed to a lower end portion of the rotation shaft 201, a base rotating motor 204 which is fixed to the slide base 105 and is adjacent to the rotation shaft 201, a timing gear 205 which is fixed to an output shaft 204*a* of the base rotating motor 204, and a timing belt 206 stretched between the timing gears 203 and 205. An output shaft 204*a* passes through the slide base 105 and projects downward. Reference numerals 207, 208 denote supporting plates projecting from both end portions of the rotation base 202.

The frame contour measurement portion 200 comprises a measuring portion 210, measuring element positioning means 250, and pressure switching means 500. The pressure switching means 500 is not shown in FIGS. 8 and 11.

(Measuring portion 210)

The measuring portion 210 comprises two guide rails 211 (only one is shown) which are stretched between the upper portion of the supporting plates 207, 208, an upper slider 212 which is held on the guide rail 211 to be movable in a length direction, a measuring shaft 213 which vertically passes through an end portion of the moving direction of the upper slider 212, a roller 214 attached to a lower end portion of the measuring shaft 213, a L-shaped member 215 mounted on an upper end portion of the measuring shaft 213, and a measuring element 216 (filler) attached to an upper end of the L-shaped member 215. A front end of the measuring element 216 coincides with a shaft line of the measuring shaft 213. The measuring shaft 213 is held in the upper slider 212 to be movable up and down and freely rotatable around the shaft line.

The measuring portion 210 further comprises a vector-radius measuring means 217 which measures and outputs the amount of movement (vector radius (i) according to the guide rail 211 of the upper slider 212, and a measuring means 218 which measures and outputs the amount of up-and-down movement (Z-axis direction) of the measuring shaft 213, namely, the amount of up-and-down movement Zi of the measuring element 216. A magnescale or linear sensor can be used in the measuring means 217, 218. The constitution thereof is well known, and its description is omitted. The measuring portion 210 further comprises lens rim measuring element 219 which is semi-cylindrical in horizontal section and is disposed on the other end portion of the upper slider 212, and a rotation shaft 220 which is mounted on a projection 212*a* on the other end portion of the upper slider 212 for the lens rim measuring element 219 in the movement direction of the upper slider 212.

The lens rim measuring element 219 positioned near the rotation shaft 200 comprises an erecting driving piece 219*a* which is disposed on the base projecting toward an opposite side to a measurement surface side, and a switch operating piece 219*b* projecting toward a side of the upper slider 212. A spring 221 is arranged between the side surface of the upper slider 212 and a side surface of the base of the erecting driving piece 219*a*. When the lens rim measuring element 219 is laid down as shown in FIG. 7(*a*), the spring 221 is situated above the rotation shaft 220, and keeps the lens rim measuring element 219 at the laid-down position. When the lens rim measuring element 219 is erected as shown in FIG. 7(*b*), the spring 221 is situated under the rotation shaft 220, and keeps the lens rim measuring element 219 at the erected position.

At the erected position, the measuring element 219 does not fall to the right side in FIG. 7 by means of a stopper (not shown). On the side surface of the upper slider 212, a micro-switch (sensor) 222 used as detection means for detecting that the lens rim measuring element 219 is laid down, and a micro-switch (sensor) 223 used as detection means for detecting that the lens rim measuring element 219 is erected, are mounted.

In FIG. 7(*a*), when the measurement portion moving motor 107 is actuated and the slide base 105 is moved leftward in FIG. 7, a front end of the erecting driving piece 219*a* is brought into contact with a plate portion 111*b* for erecting the lens rim filler of the holder 111, and the lens rim measuring element 219 is rotated clockwise around the rotation shaft 220 against the elastic force of the spring 221. According to this rotation of the measuring element 219, when the spring 221 goes beyond the rotation fly 200 and moves upward, the lens rim measuring element 219 is erected by the elastic force of the spring 221, and is held at the erected position shown in FIG. 7(*b*) by the stopper (not shown) and the spy 221.

The micro-switch 222 is directly switched "ON" with the measuring surface of the lens rim measuring element 219 when the measuring element 219 is laid down, and the micro-switch 223 is switched "ON" with the switch operating piece 219*a* when the lens rim measuring element 219 is erected. Reference numeral 208*a* denotes a slider stopper mounted on the supporting plate 208, reference numeral 224 denotes an arm attached to the supporting plate 208, and reference numeral 225 denotes a micro-switch (sensor) mounted on a front end portion of the arm 224. The micro-switch 225 is switched "ON" when the upper slider 212 comes into contact with the slider stopper 208*a*, and detects an initial position of the upper slider 212.

On the side surface of the upper portion of the supporting plate 207, a pulley 226 is held rotatably, and an end portion of a wire 227 is fixed to an end portion of the upper slider 212. The other end portion of the wire 227 is engaged with an end portion of the spring 228, and the other end portion of the spring 228 is mounted in the front end portion of the arm 224. Additionally, the wire 227 is stretched on the pulley 226.

(Measuring element position determining means 250)

The measuring element position determining means 250 comprises two guide rails 251 (only one is shown) which are stretched under the supporting plates 207, 208, a lower slider 252 which is held on the guide rails 251 (only one is shown) to be horizontally movable in a length direction, a driving motor 253 which is disposed under the lower slider 252 and is fixed to the rotation base 202, and an engagement pin (stopper) 254 which is adjacent to the driving motor 253 and projects from near the center of a side surface of the rotation base 202.

Rack tooth 255 are arranged in a movement direction under the lower slider 252, and engagement pins (stoppers) 256, 257 are spaced in the movement direction and are mounted projecting from the lower slider 252. A gear 258 engaged with the rack tooth 255 is fixed to an output shaft of the driving motor 253. The engagement pin 256 is situated slightly higher than the engagement pin 257, and a shaft elevation operating member 259 is disposed on a side of the lower slider 252.

The shaft elevation operating member 259 is shaped like L from a long piece 259*a* which is between the engagement pins 256, 257 and a short piece 259*b* which is obliquely armed integrally with the lower end of the long piece 259*a*. A curved part of the shaft elevation operating member 259 is rotatably held on a vertically middle portion of a side surface of the lower slider 252 by the rotation shaft 260. A spring 261 is arranged between a front end portion of the short pier 259*b* and an upper portion of the side surface of the lower slider 252.

At a position where the long pie 259*a* is in contact with the engagement pin 256, the spring 261 is disposed at upper side than the rotation shaft 260, and presses the long piece 259*a* against the engagement pin 256. At a position where the long piece 259*a* is in contact with the engagement pin 257, the spring 261 is disposed at lower side than the rotation shaft 260, and presses the long piece 259*a* against the engagement pin 257.

A supporting plate 262 extending upward is attached to an end portion of the lower slider 252, and a pushing shaft 263 passing through an upper end portion of the supporting plate 262 is held on the supporting plate 262 so as to freely proceed and recede in a movement direction of the lower slider 252. A retainer 264 for preventing release is attached to an end portion of the pushing shaft 263. A large-diameter pushing portion 263*a,* which fits an end portion surface 212*b* of an end portion of the upper slider 212, is formed integrally with the other end portion of the pushing shaft 263. A spring 265 wound on the pushing shaft 263 is arranged between the large-diameter pushing portion 263*a* and the supporting plate 262. The pushing portion 263*a* is in contact with the end portion surface of the end portion of the upper slider 252 by means of the elastic force of the springs 228, 265.

The frame contour measuring apparatus 1 as constituted in the above is, as mentioned later, capable of obtaining the contour of the eyeglass frame MF or the contour of the lens-shaped template in the form of vector radius ρi relative to an angle θi, in other words, in the form of lens contour information (θi, ρi) representing polar coordinates.

(2) Lens Edging Apparatus 2

As shown in FIG. 2, the lens edging apparatus 2 includes a grinding portion 60 (detailed drawing are omitted) that grinds the edge of an uncut lens. In the grinding portion 60, the uncut lens is held between a pair of lens-rotating shafts of a carriage, and the rotation of the shafts and the up and down movement of the carriage are controlled based on lens contour information (θi, ρi), and thus the edge of the uncut lens is ground with a grindstone. Since this structure of the grinding portion 60 is well known, a detailed description thereof is omitted.

The lens edging apparatus 2 further includes an operation panel portion 61 (keyboard) serving as a data input means, and a liquid crystal display panel 62 (display device) serving as a display means, and a control circuit 63 (control means) (see FIG. 1) that controls the grinding portion 60 and the liquid crystal display panel 62.

Figure 9:
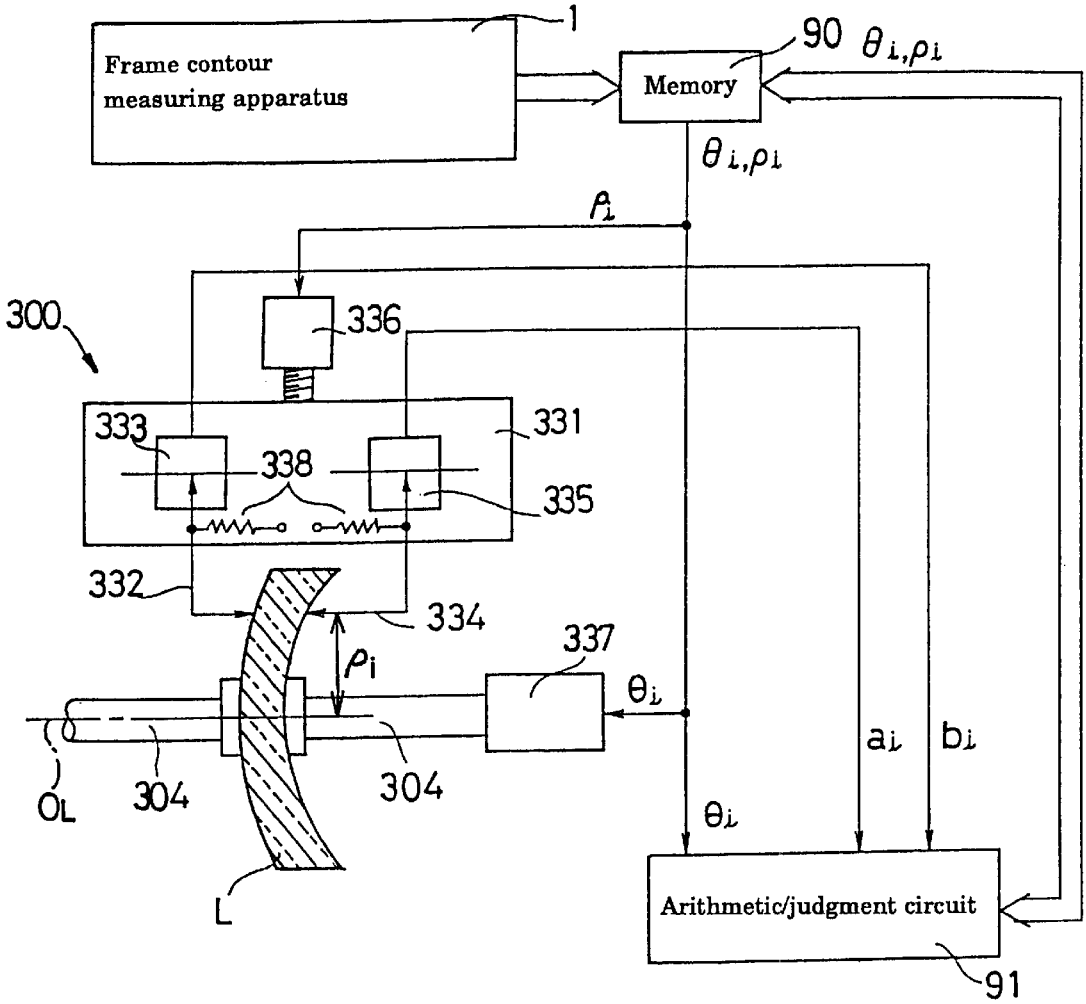
FIG. 9 is a view for explaining lens-thickness measuring portion of lens edging machine shown in FIG. 2.

The lens edging apparatus 2 further includes lens thickness measuring device 300 (lens thickness measuring means) that measures the thickness of the edge of the uncut lens, based on the lens contour information (θi, ρi) obtained by the frame contour measuring apparatus 1, as shown in FIG. 9. The construction and operation of the lens thickness measuring device 300 are the same as those disclosed in Japanese Patent Application No. hei 1-9468.

(Lens thickness measuring means)

Figure 10A:
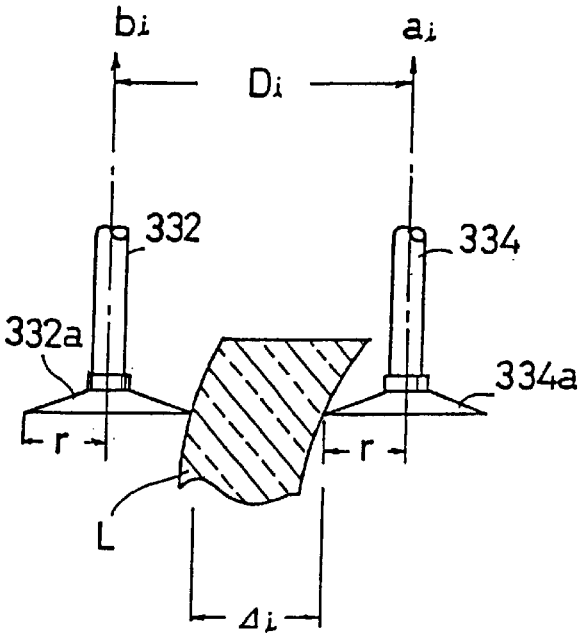
FIGS. 10(*a*) to 10(*c*) are views for explaining the operation of fillers shown in FIG. 9.

The lens thickness measuring device 300 has a stage 331 that is moved forwards and backwards by a pulse motor 336. The stage 331 is provided with fillers 332, 334 between which the uncut lens L is placed. The fillers 332, 334 are pressed in directions in which they approach each other by means of the force of springs 338, 338 so as to be always in contact with front and back surfaces (front and back refracting surfaces) of the uncut lens L, respectively. As shown in FIG. 10(A), the fillers 332, 334 have disks 332*a,* 384*a* that are freely rotatable, respectively. The disks 332*a,* 334*a* have a radius of τ.

Lens rotating shads 304, 304 of the carriage (not shown) are disposed to be driven and rotated by a pulse motor 337, and the uncut lens L is clamped between the lens rotating shafts 304, 304. Accordingly, the uncut lens L is driven and rotated by the pulse motor 337. The optical axis OL of the lens L is caused to coincide with the shaft line of the lens rotating shafts 304, 304.

Figure 10B:
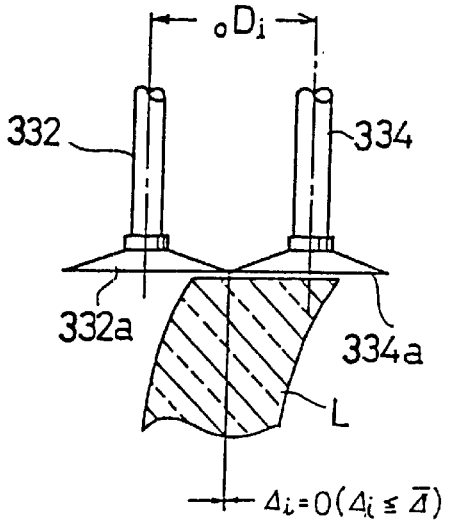
Figure 10C:
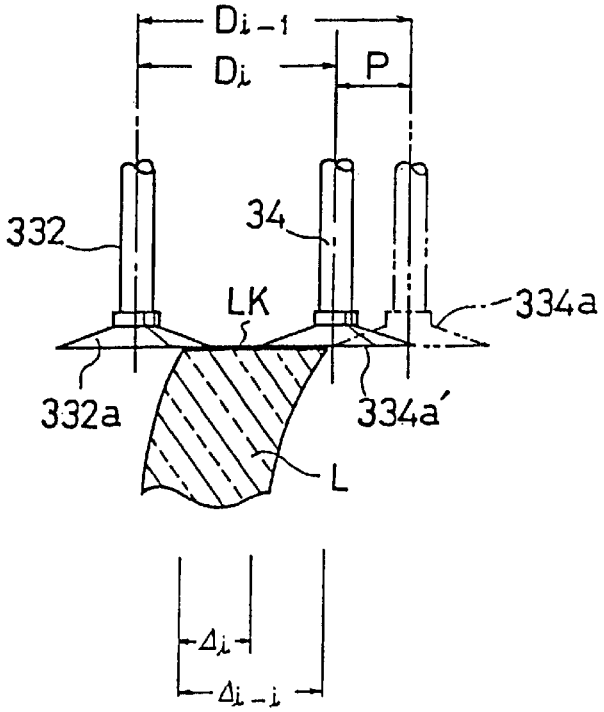

Angle information θi' is of radius vector information (θi, ρi,) from a memory 90 is input into the pulse motor 337, and, according to the angular information θi', the lens L is rotated from a reference position by an angle of θi. On the other hand, the radius vector length ρi is input into the pulse motor 336, and the disks 332*a,* 334*a* of the fillers 332, 334 are moved forwards and backwards through the stage 331, and are positioned at points away from the optical axis OL by the radius vector length ρi, as shown in FIG. 9. The amounts ai and bi, shown in FIG. 10 (A), of movement of the fillers 332, 334 at the points are then detected by encoders 333, 335, and detection signals from the encoders 333, 335 are input in arithmetic/judgment circuit 91.

The arithmetic/judgment circuit 91 performs a calculation according to the formulas bi-ai=Di, Di-2τ=Δi and obtains lens thickness Δi.

(Control means, etc.)

Figure 3:
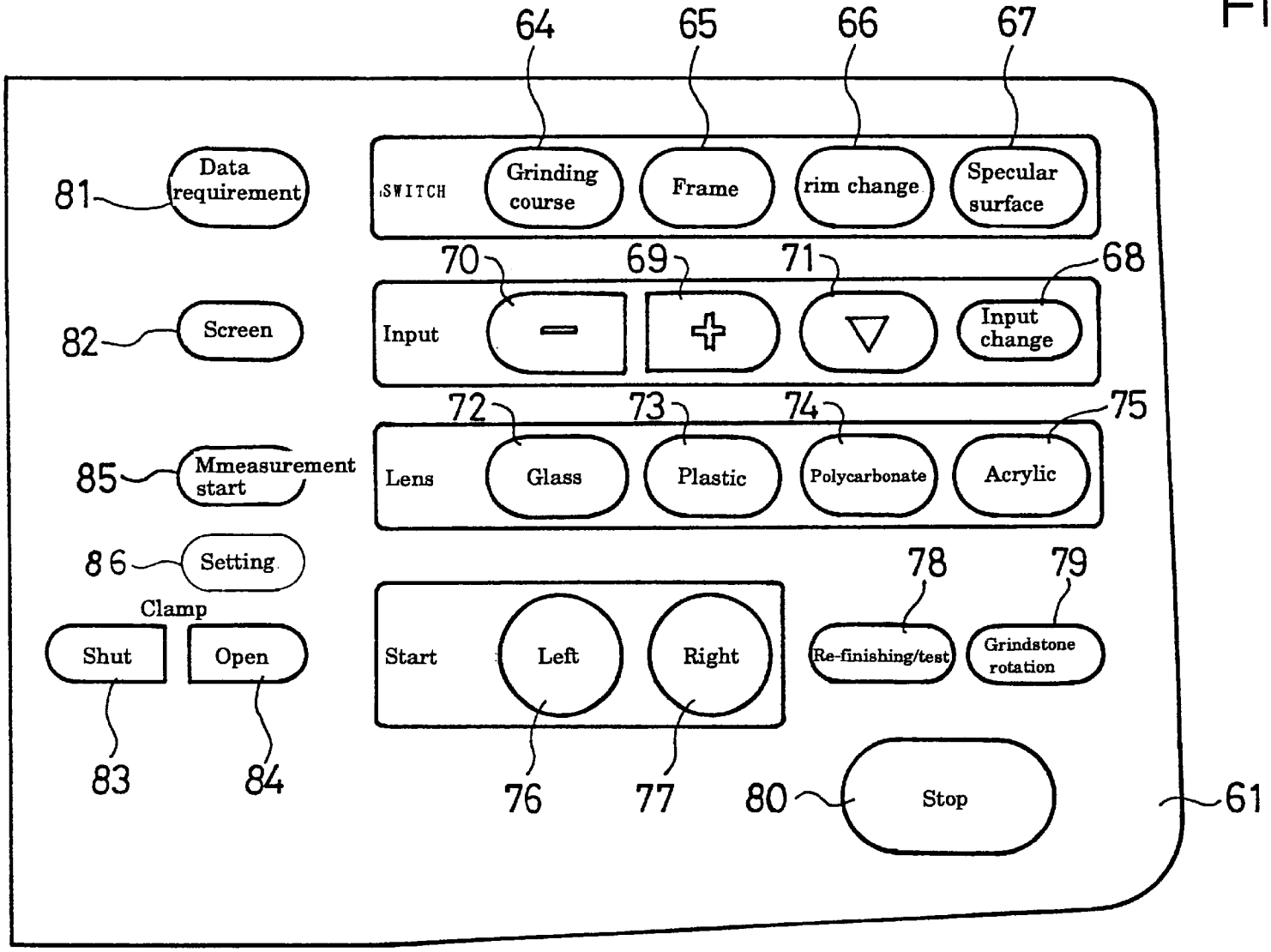
FIG. 3 is an enlarged explanation view of a control panel shown in FIGS. 1 and 2.

As shown in FIG. 3, the operation panel portion 61 has grind course switch 64 for making a changeover among an "auto" mode in which the edge and V-edge of a lens are ground, a "monitor" mode of a manual operation, etc., a "frame" mode switch 65 for selecting a material of an eyeglass frame, a "frame change" mode switch 66 for putting the old lenses into a new eyeglass frame using the old lenses, and a "specular surface" mode switch 67 for specularly processing eyeglass lenses.

The operation panel portion 61 further has an "input change" mode switch 68 for a pupil distance PD, a frame geometric center distance FPD, an upset UP, etc., a "+" input switch 69 or setting a "+(plus)" input, a "−" input switch 70 for setting a "−(minus)" input, a cursor key 71 for moving a cursor rim 71*a,* a switch 72 for selecting glass as lens material, a switch 73 for selecting plastic as lens material, a switch 74 for selecting polycarbonate as lens material, a switch 75 for selecting acrylic resin as lens material.

The operation panel portion 61 further has a start switch including a switch 76 for grinding a "left" lens and a switch 77 for grinding a right" lens, a "re-finishing/test" mode switch 78, a "grindstone rotation" switch 79, a stop switch 80, a data requirement switch 81, a screen switch 82, a switch 83 for shutting a pair of lens shafts of the grinding portion 60, a switch 84 for opening a pair of lens shaft of the grinding portion 60, a switch 85 for starting the measurement of lens thickness, a setting switch 86.

Figure 1:
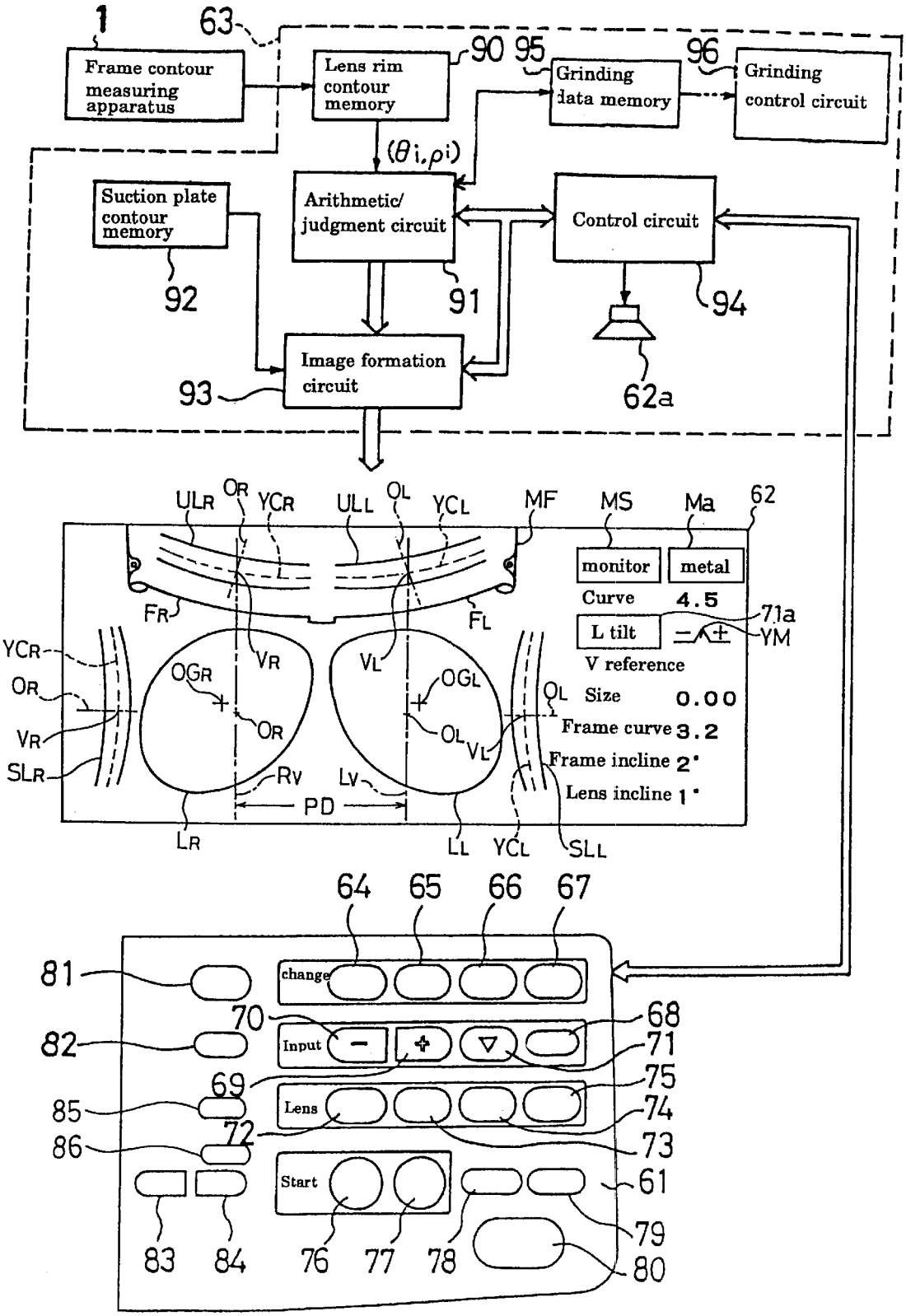
FIG. 1 shows a control circuit of an apparatus for determining fitness of eyeglass lens according to the present invention.

As shown in FIG. 1, the control at 63 includes lens rim contour memory 90 that stores the lens contour information (θi, ρi) obtained from the frame contour measuring apparatus 1, an arithmetic/judgment circuit 91 (an arithmetic control circuit) into which the lens contour information (θi, ρi) is input from the lens rim contour memory 90, a suction plate contour memory 92, an image formation circuit 93 in which an image data is constructed based on the data obtained from the arithmetic/judgment circuit 91 and from the suction plate contour memory 92, and thereby a liquid crystal display panel 62 is caused to display images and data, a control circuit 94 that controls the image formation circuit 93, the operation panel portion 61 (V-shaped contour data input means), a caution buzzer 62*a,* etc., by control commands of the arithmetic control means, arithmetic/judgment circuit 91, a grinding data memory 95 that stores grinding data required by the arithmetic/judgment circuit 91, and a grinding control portion 96 that controls the operation of the grinding portion 60 in accordance with the grinding data stored in the grinding data memory 95.

A description will next be given of the control performed by the arithmetic/judgment circuit 91 of the constructed apparatus.

(i) Holding of an eyeglass frame MF in the frame contour measuring apparatus 1

When the contour of the eyeglass frame MF is measured according to the aforementioned construction, lens rim holder 111 shown in FIG. 7 is kept removed from a holder supporting pieces 109 as shown in FIG. 8. In this construction, inclined guide plate portions 48*c,* 48*c* of frame guide members 48, 48 are inclined in a direction in which a space becomes progressively larger toward their upper ends.

Accordingly, as shown in FIG. 6(*a*), the eyeglass frame MF is disposed between the guide plate portions 48*c,* 48*c* and is then pressed from above against the elastic force of a coil spring 40. As a result, the space between the frame guide members 48, 48, namely, the space between movable supporters (sliders) 37, 37 is enlarged according to the guide operation of the inclined guide plate portions 48*c,* 48*c,* and thereby the rim of the eyeglass frame MF, namely, the lens rims LF (RF) of the eyeglass frame MF is moved onto the holding claws 43, 43 and is engaged with the holding claws 43, 43.

In this state, if an operation lever 27 is turned from the position "open" to the position "close", this rotation movement is transmitted to a cylindrical shaft 33 through a rotation shaft 25, gears 26, 24, and an operation shaft 23, and thereby a part of a spring 36 is wound around the cylindrical shaft 33. Accordingly, a claw mounting plate 42 is rotated upward centering a side 42*a* of the plate 42 through a wire 36 connected to the spring 35, and the space between the holding claws 43, 44 is narrowed as shown in FIG. 6(*c*). As a result, the lens rim LF (RF) of the eyeglass frame MF is held between the holding claws 43, 44. At this position, a movable pin 31 is held at a lower end portion 20*a* of a circular slit 20 by means of the elastic force of a spring 32.

In order to remove the lens rim LF (RF) of the eyeglass frame MF from between the holding claws 43, 44, the operation lever 27 is operated reversely to the above-mentioned operation, and thereby each member is actuated reversely.

(ii) Lens rim contour measurement (Measurement of the contour of a lens rim (lens rim) of an eyeglass frame)

Figure 11A:
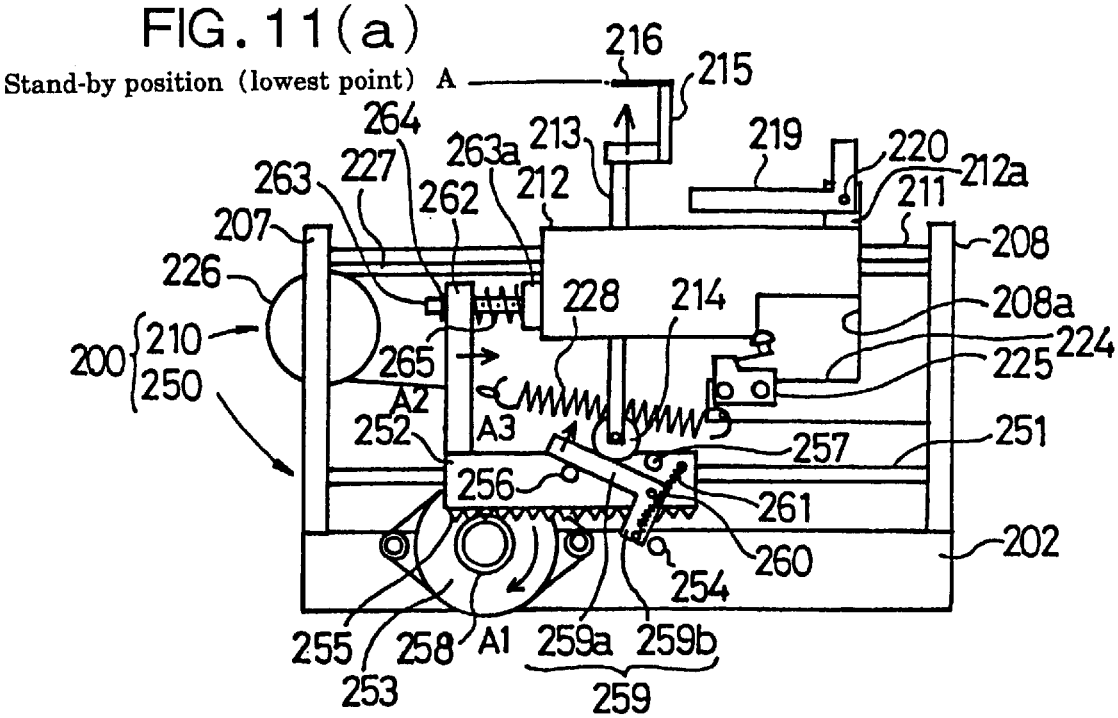
FIGS. 11(*a*) to 11(*c*) are views for explaining the operation of the measuring portion of the frame contour measuring apparatus.
Figure 11B:
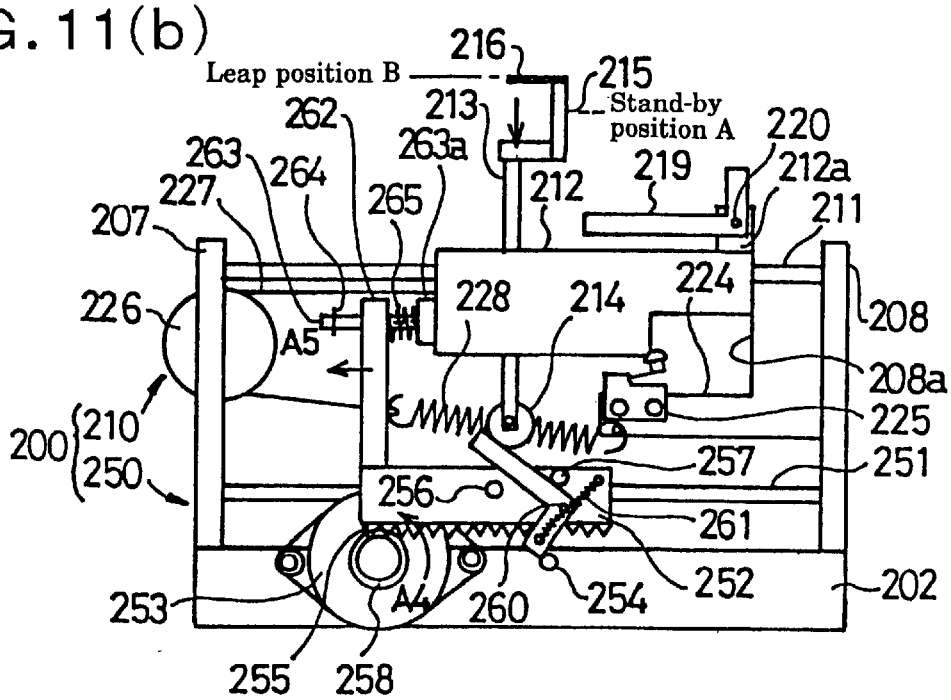
Figure 11C:
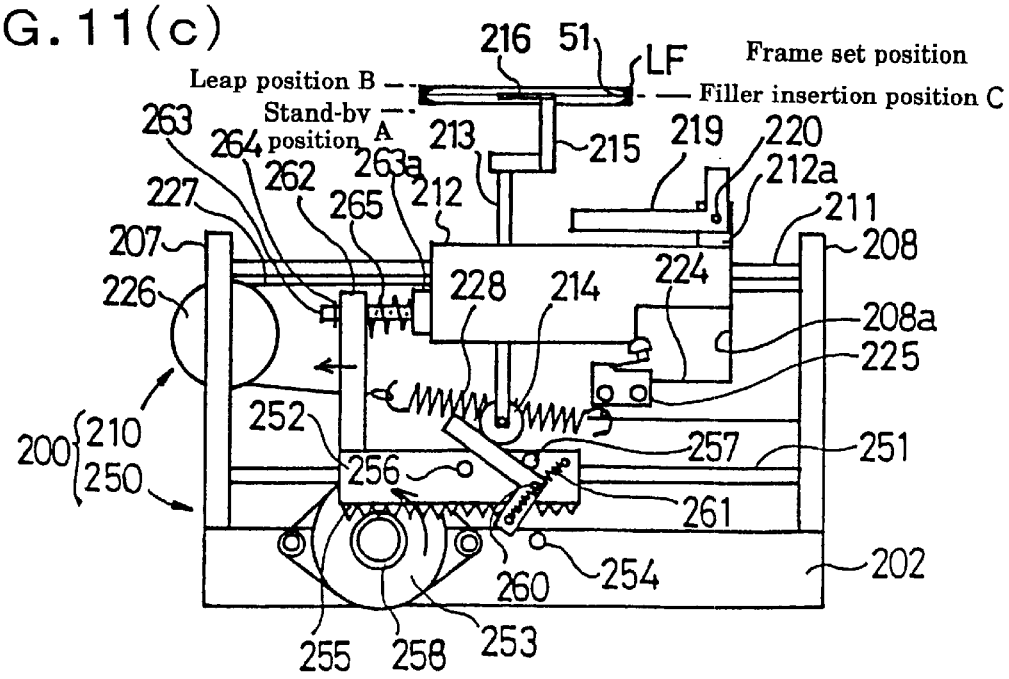

Meanwhile, when an electric power supply of the frame contour measuring apparatus 1 is turned ON, signals from micro switches 110, 222, 223, 225 are input into the arithmetic means (not shown) (the arithmetic and control circuit) of the frame contour measuring apparatus 1, and the arithmetic means judge detection states of the micro switches 110, 222, 223, 225. In FIG. 11(*a*), a long piece 259*a* of a shaft elevation operating member 259 is in contact with an engagement pin 257 by the elastic force of a spring 261. At this position, a measuring element 216 is located at a stand-by position (A). In the following description, measurement is set, for example, such that the lens rim RF of the eyeglass frame MF is measured after the measurement of the lens rim LF thereof is completed.

When a start switch 13 is turned ON in a state in which, as mentioned above, the lens rim LF (RF) of the eyeglass frame (MF) is kept held between the holding claws 43, 44, a driving motor 253 is actuated, and as shown by arrow A1, a gear 258 is rotated clockwise, thereafter a lower slider 252 moves rightward in the figure, and as shown by arrow A2, an upper slider 212 moves by means of a pressure shaft 263 rightward in the figure. At this time, a short portion 259*b* of the shaft elevation operating member 259 is brought into contact with a engagement pin 264.

Thereafter, a lower slider 252 moves rightward and the shaft elevation operating member 259 is rotated clockwise centering a rotation shaft 260 as shown by arrow A3, and a measurement shaft 213 is pushed up through a roller 214 from the stand-by position (A) to an upper side by the shaft elevation operating member 259. According to this movement, when the spring 261 moves to the upper side of the rotation shaft 260, the shaft elevation operating member 259 is abruptly rotated to the upper side by the elastic force of a spring 261. As a result, a long piece 259*a* of the shaft elevation operating member 259 collides with the engagement pin 254, and the measurement shaft 213 moves to upper side by means of the inertial force, and the measuring element 216 moves abruptly to leap position B ascending to upper edge of the lens rim (LF). Thereafter, the measurement shaft 213 and the measuring element 216 slightly move down, and the roller 214 comes into contact with the short portion 259*b*, and thereby the measuring element 216 is situated at measuring-element insertion position C (filler insertion position) to face a valley of the V-shaped groove of the lens rim LF.

Correspondingly to this movement, when the measuring element 216 is ascended to the measuring-element insertion position C, the micro switch 225 is turned ON by the upper slider 252. Thereby, the driving motor 253 is rotated reversely, the gear 258 is then rotated counterclockwise as shown by arrow A4 in FIG. 11(*b*), the lower slider 252 moves leftward as shown by arrow A5, and the front end of the measuring element 216 is engaged with the valley (center) of the V-shaped groove 51 of the lens rim LF.

Thereafter, when the lower slider 252 is further moved leftward as shown by arrow A5, the pressure part 263*a* of the pressure shaft 263 is caused to recede from the upper slider 252 as shown in FIG. 8(*b*). At this position, the measuring element 216 is pressed to the valley of the V-shaped groove 51 of the lens rim LF by means of the elastic force of the spring 228.

In this state, according to rotation of the base rotating motor 204, the front end of the measuring element 216 is moved along the V-shaped groove 51 of the lens rim LF. At this time, the upper slider 212 is moved along a guide rail 211 according to the contour of the V-shaped groove, and the measurement shaft 213 is moved upward or downward according to the contour of the V-shaped groove.

Also, the movement of the upper slider 212 is detected by a radius vector measuring means 217, and the up and down movement of the measurement shaft 213 is detected by a measuring means 218. Further, the radius vector measuring means 217 calculates the amount of movement of the upper slider 212 starting from the position where the upper slider 212 is in contact with a stopper 208*a* of a supporting plate 208. The outputs of the measuring means 217, 218 are input to an arithmetic means (not shown) (an arithmetic and control circuit).

The arithmetic and control circuit calculates a radius vector ρi of the valley of she V-shaped groove 51 of the lens rim LF, based on the output from the measuring means 217, and allows a memory (not shown) to store radius vector information (θi, ρi) obtained by correlating the radius vector ρi with the rotation angle θi of the base rotating motor 204. On the other hand, the arithmetic and control circuit calculates the amount Zi of movement in the up and down direction (Z-axis direction), based on the output from the measuring means 218, and allows the memory (not shown) to store lens rim contour information (θi, ρi, Zi) obtained by correlating the amount Zi of movement with both the rotation angle θi and the radius vector ρi.

(Measurement of lens rim contour such as a template and a demonstration lens)

In a case where the lens rim contour such as a template and a demonstration lens is measured by the use of lens rim holder 111 as shown in FIG. 7(*a*), a motor 107 is actuated, thereby moving the slide base 105 leftward in FIG. 7.

Correspondingly to this movement, the front end of an erecting driving piece 219*a* is brought into contact with lens rim filler erecting plate portion 111*b* of the lens rim holder 111, and thereby lens rim measuring element 219 is rotated clockwise centering a rotation shaft 220 against the elastic force of a spring 221. At this time, a micro switch 222 is turned OFF.

When the spring 221 is moved upward beyond the rotation shaft 220, the lens rim measuring element 219 is erected by the force of the spring 221, and is held at an erected position, as shown in FIG. 7(*b*), by the operation of a stopper (not shown) and the spring 221. At this position, the switch 223 is turned ON by a switch operating piece 219*b*of the lens rim measuring element 219, and the signal is input to the arithmetic and control circuit (not shown).

When the arithmetic and control circuit receives the ON signal from the micro switch 223, the driving motor 253 is actuated, the gear 258 is rotated counterclockwise, and thereafter the lower slider 252 is moved leftward. As a result, the pressure part 263*a* of the pressure shaft 263 is caused to recede from the lower slider 252 as shown in FIG. 8(*a*). Correspondingly to this movement, the upper slider 212 is moved leftward by the elastic force of the spring 228, and the measuring surface of the lens rim measuring element 219 is in contact with the edge of lens rim 112, as shown in FIG. 8(*a*).

In this state, according to the rotation of the base rotating motor 204, and the lens rim measuring element 219 moves following the edge of the lens rim 112. Additionally, the movement of the upper slider 212 is detected by the radius vector measuring means 217, and the output from the radius vector measuring means 217 is input to the arithmetic and control circuit (not shown).

The arithmetic and control circuit calculates a radius vector ρi of the lens rim 112 based on the output from the radius vector measuring means 217, and allows a memory (not shown) to store the lens rim contour information, i.e., radius vector information (θi, ρi) obtained by correlating the radius vector ρi with the rotation angle θi of the base rotating motor 204.

(iii) Measurement of the lens thickness of an uncut lens based on lens rim contour information When the data requirement switch 81 of the lens edging apparatus 2 is turned ON, in the same way as described above, the lens rim contour information, i.e., radius vector information (θi, ρi) of lens rim such as a template and a demonstration lens, which is required by the frame contour measuring apparatus 1 or the lens rim contour information (θi, ρi, Zi) of lens rim (lens rim contour) is transmitted to the lens rim contour memory 90 of the lens edging apparatus 2, and the memory 90 stores the information.

On the other hand, the uncut lens L is clamped between the lens rotating shafts 304, 304, and then the switch 85 is turned ON. Thereby, the arithmetic/judgment circuit 91 allows a driving means (not shown) to enlarge the space between the fillers 332, 334, and actuates the pulse motor 336 to cause the fillers 332, 334 to face the front and back refractive surfaces of the uncut lens L, respectively. Thereafter, the driving means (not shown) releases from enlarging the space between the fillers 332, 334, and the fillers 332, 334 are brought into contact with the front and back refractive surfaces of the uncut lens L, respectively. Thereafter, based on the lens rim contour information (θi, ρi, Zi) or the radius vector information (θi, ρi), the arithmetic/judgment circuit 91 actuates the pulse motor 337 so as to rotate the lens rotating shafts 304, 304 and rotate the uncut lens L, and, at the same time, actuates and controls the pulse motor 336. At this time, the arithmetic/judgment circuit 91 calculates lens thickness Δi in the lens rim contour information (θi, ρi, Zi) or the radius vector information (θi, ρi) based on the output from the encoder 335, and then allows the grinding data memory 95 to store the lens thickness Δi.

(iv) V-shaped tilt process

Figure 12:
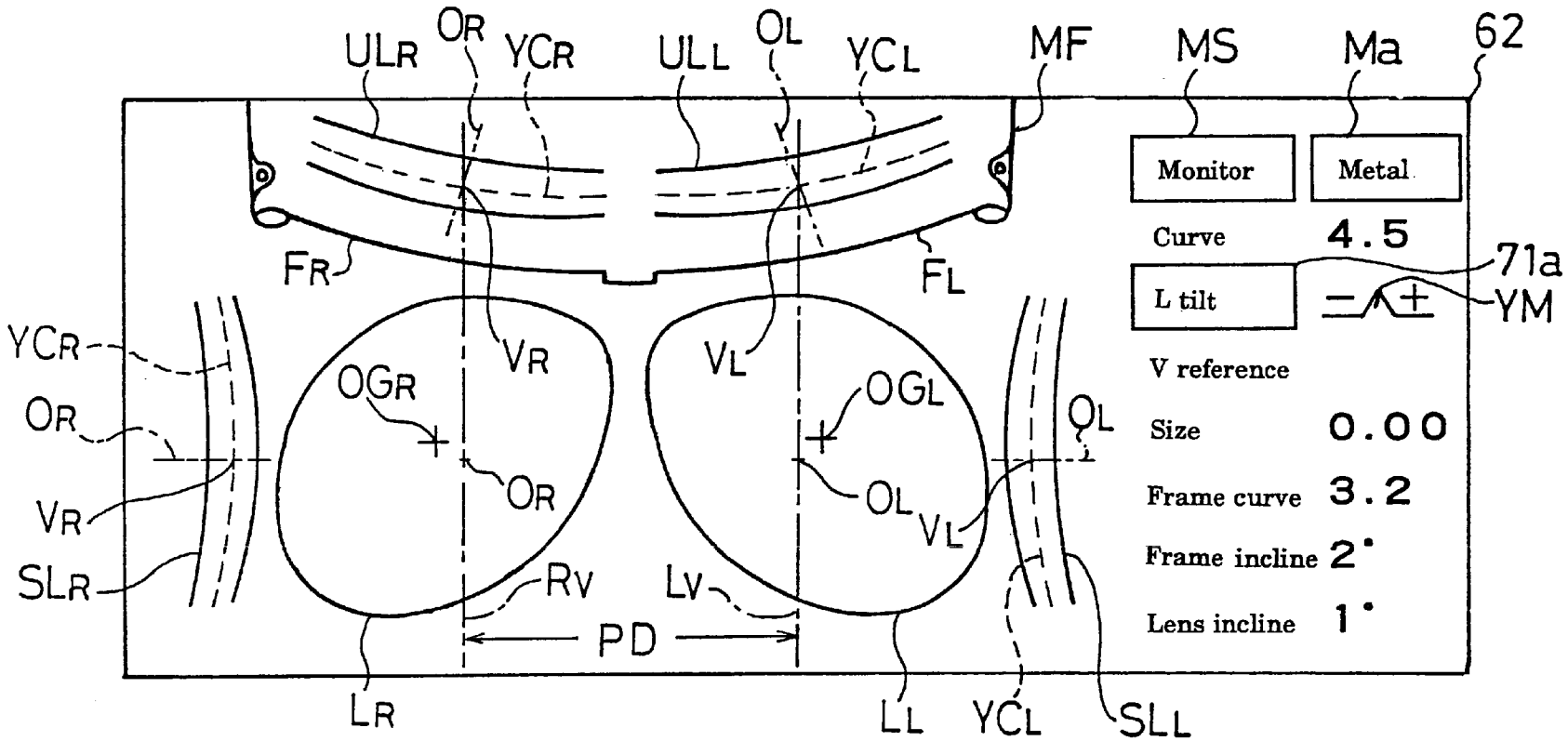
FIG. 12 is a schematic view of a display of a liquid crystal panel of the lens edging machine shown in FIG. 2.

Next, when the switch 64 is turned ON to select the "monitor" mode in the grinding course, a menu screen (V-shaped simulation screen) such as shown in FIG. 12 is displayed on a liquid crystal panel 62 by an arithmetic/judgment circuit 91. Next, the arithmetic/judgment circuit 91 operates the control of the V-shaped tilt process.

At the left portion and right portion in the center of the liquid crystal panel 62, lens rim contour of the right eyeglass lens LR (eyeglass lens contour or lens rim contour) and lens rim contour of the left eyeglass lens LL (eyeglass lens contour or lens rim contour) are displayed in original size, respectively. These lens contours LR and LL, based on the lens rim contour information (θi, ρi), include lens rim contour of the eyeglass frame or frameless eyeglass lens contour or model lens contour, etc.

In addition, at the upper portion of the liquid crystal panel 62, the eyeglass frame MF and the left lens rim FL and the right lens rim FR of the eyeglass frame MF, and the upper edges ULL and ULR of the lens rim contours LR and LL of the eyeglass lens (view from the upper side) are displayed. Said eyeglass frame MF is used to indicate the tilt of the frame.

Also, at the side portion of eyeglass lens LR and LL of the liquid crystal display 62, the side edges SLL and SLR of the eyeglass lens rim contours LR and LL of the eyeglass lens are displayed Also, at the upper edges ULL and ULR and the side edges SLL and SLR, V-shaped curves YCR and YCL are displayed as the dashed line. Further, OR and OL indicate the optical axis of the lens rim contours LR and LL (the optical axes of the right and left eyeglass lens), the distance between two optical axes OR and OL indicates the pupil distance (PD). Further, OGR and OGL indicate the geometrical center of the lens rim contours LR and LL.

An intersection point of the V-shaped curve YCR and the optical axis OR of the upper edge ULR becomes the right V tilt reference position VR, and an intersection point of the V-shaped curve YCL and the optical OL of the upper edge ULL becomes the left V tilt reference position VL.

In addition, at the right portion of the liquid crystal panel 62, a mode selection frame MS and lens frame material selection frame Ma are displayed, "monitor" is selectively displayed in the mode selection frame MS, and "metal" of frame material is selectively displayed in the lens frame material selection frame. Then, at the lower side of the mode selection frame MS, items such as "curve", "L tilt", "V reference", "size", "frame curve", "frame tilt" and "lens tilt", etc. are displayed. Curve value (4.5 in the FIG. 12) is displayed in the side direction of "curve", V-shaped figure provided with +, − is displayed in the side direction of "L tilt", size (0.00 in the FIG. 12) is displayed in the side direction of "size", curve value (3.2 in the FIG. 12) is displayed in the side direction of "frame curve", tilt value of the frame (2° in the FIG. 12) is displayed in the side direction of "frame tilt ", and tilt value of the lens (1 □ in the FIG. 12) is displayed in the side direction of "lens tilt". Further, at the lower side of the mode selection frame MS, a cursor 71*a* (selection frame) for selecting one of the items such as "curve", "L tilt", "V reference", "size", "frame curve", "frame tilt", and "lens tilt", etc. is displayed.

Figure 13:
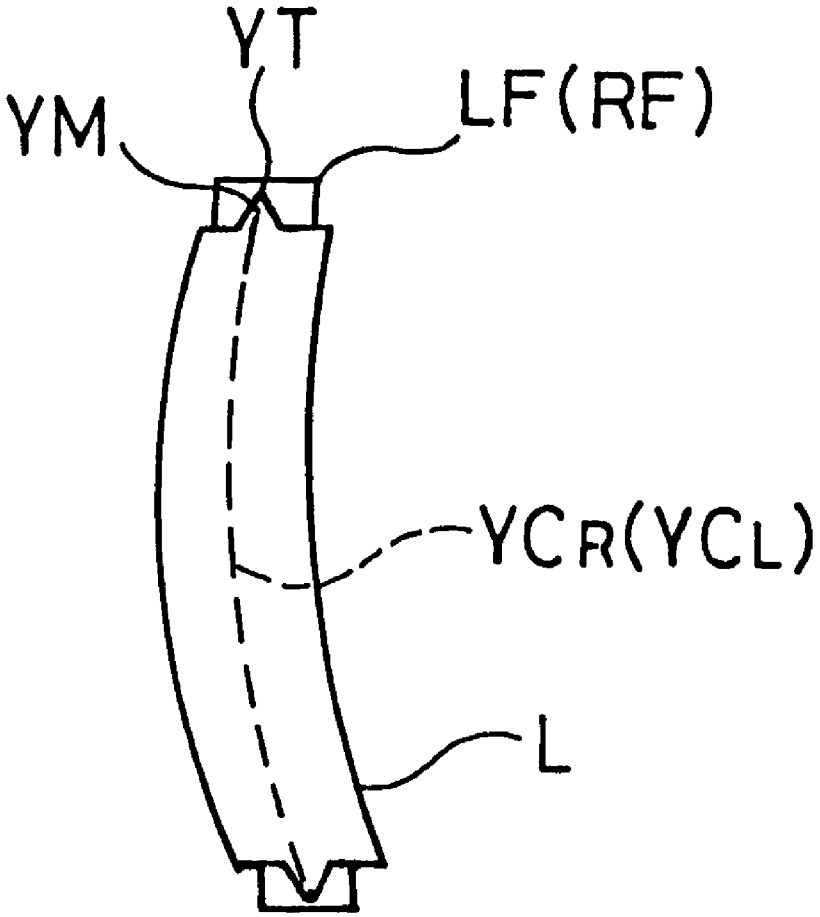
FIG. 13 is a view for explaining the relation between a V-shaped position and a rim of an eyeglass frame.

FIG. 13 shows the relation of the eyeglass lens L of the lens rim contours LR and LL, and the sectional contours of the left and right lens rims LF and RF of the eyeglass frame MF.

However, in order to operate the tilt of the V-shaped curves YCR, YCR in the menu screen shown in the FIG. 12, cursor key 71 is operated to select the L tilt item displaying the cursor rim 71*a,* and then V reference or H reference is selected. The V reference is considered as a reference of the vertical tilt (the vertical reference tile operation), and the H reference is considered as a reference of the horizontal tilt (the horizontal reference tilt H operation).

Figure 14:
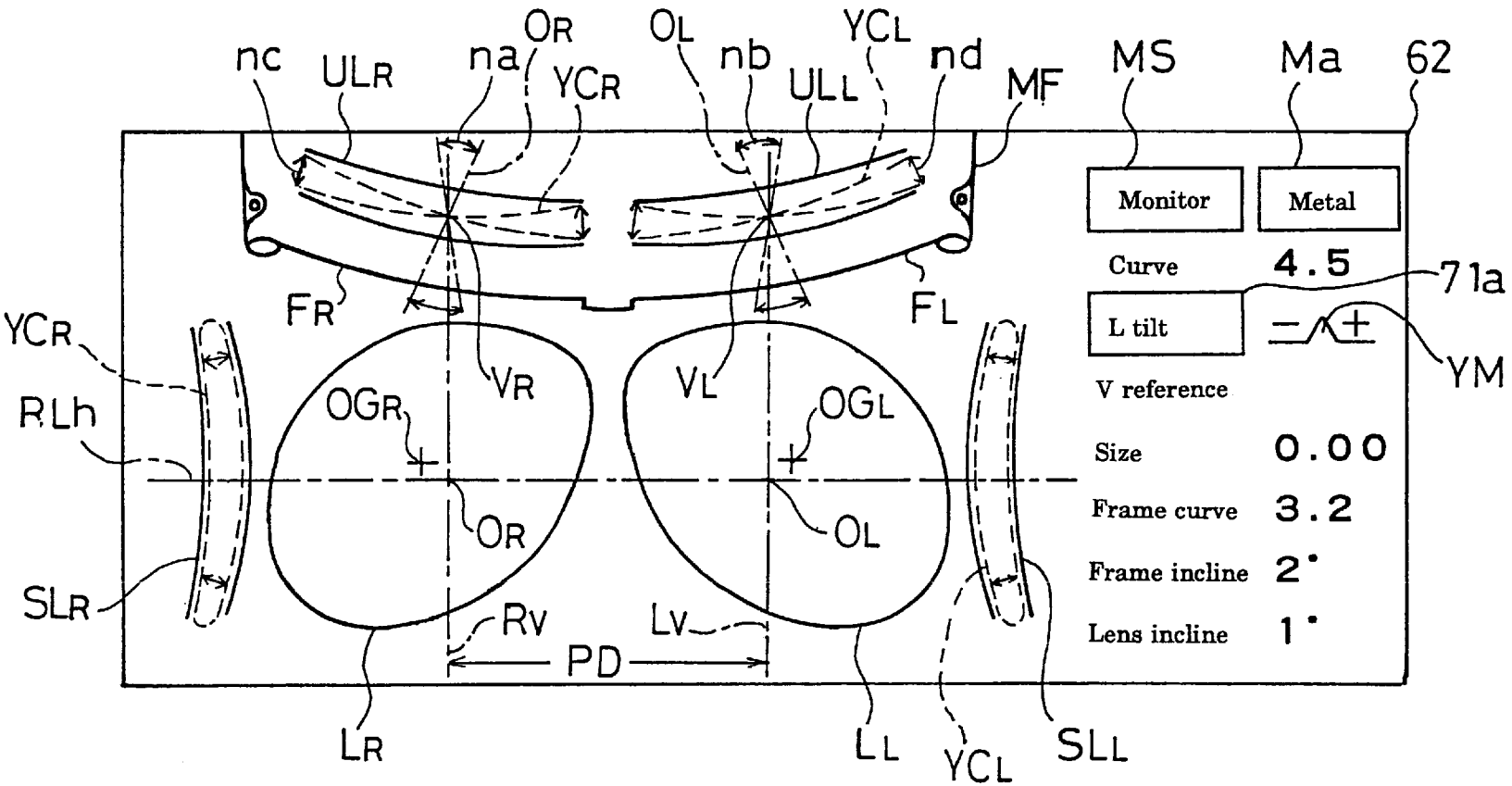
FIG. 14 is a view for explaining a display of the liquid crystal panel shown in FIG. 12.

And, the V tilt reference lines Rv and Lv are moved, for example, to the position displaying PD in the FIGS. 12 and 14, that is, to the position of the optical axes OR and OL of the lens rim contours LR and LL, then the optical axes OR and OL are rotated centering the V tilt reference lines Rv and Lv as shown the arrows na and nb so that V-shaped curve (V-shaped locus) YCR, YCR integrally with the optical axes OR and OL is tilted as shown the arrows nc and nd. Said tilt is compared with the frame tilt form of the frame view from upper side (view for indicating the tilt of the frame) tilted within the range of the eyeglass lens edge surface, and it is possible to simulate the virtual assembling of the eyeglass frame of the eyeglass lens which are finally ground for better fitting with the eyeglass frame.

Figure 15:
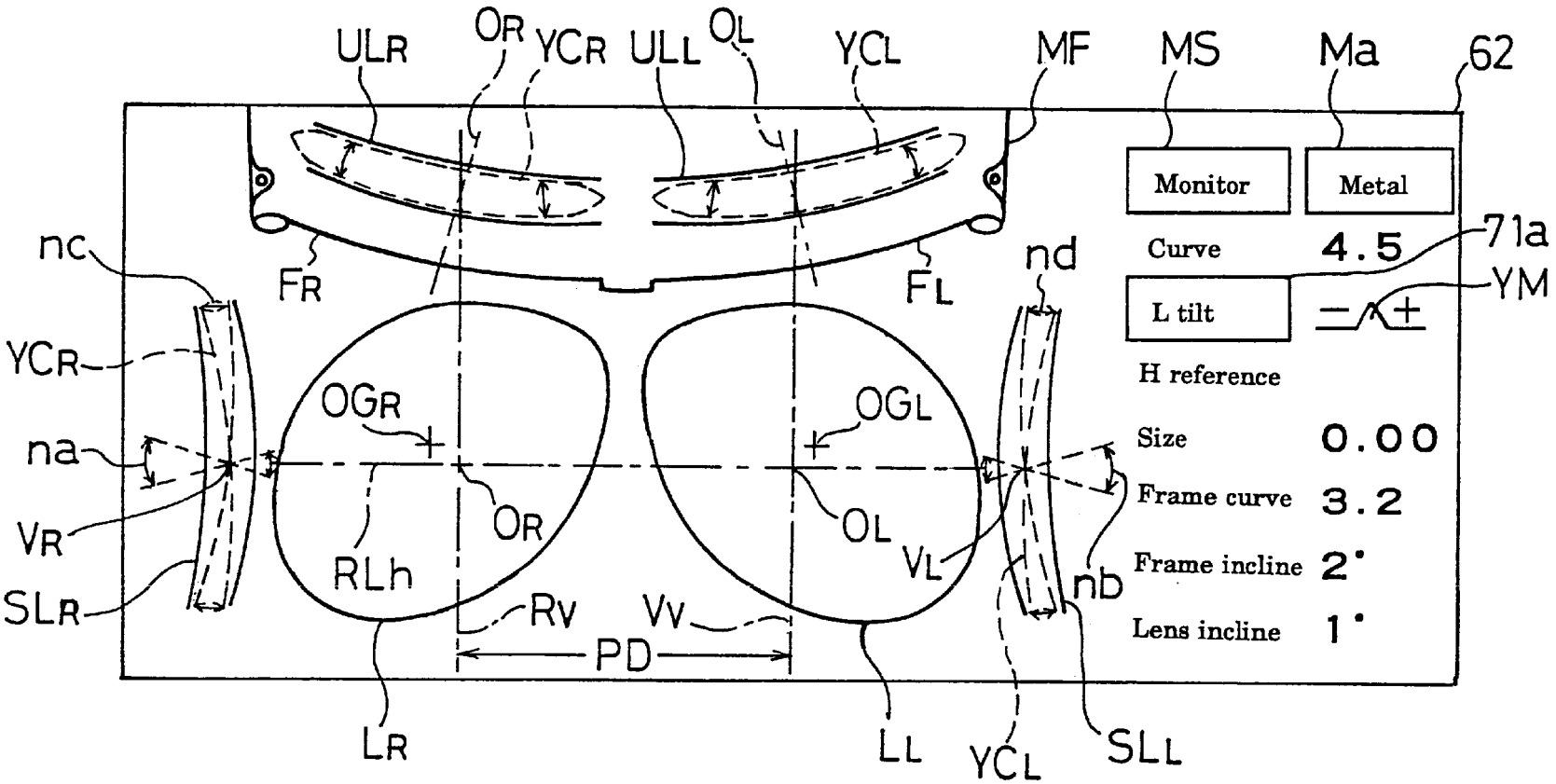
FIG. 15 is a view for explaining a display of the liquid crystal panel shown in FIG. 12.

Also, H tilt reference line RLh is moved, for example to the position displaying PD in the FIG. 15, that is, to the position of the optical axe OR and OL of the lens rim contours LR and LL, then the optical axes OR and OL are rotated centering the H tilt reference line RLh as shown the arrows na and nb so that V-shaped curves (V-shaped locus) YCR, YCR integrally with the optical axes OR and OL is tilted as shown the arrows nc and nd. Said tilt is compared with the frame tilt form of the frame view from upper side (view for indicating the tilt of the frame) tilted within the range of the eyeglass lens edge surface, and it is possible to simulate the virtual assembling of the eyeglass frame of the eyeglass lens which are finally grounded for better fitting with the eyeglass frame.

Also, in the picture image display of the virtual assembling, it is possible to display the lens view from upper side of the eyeglass lens, which are finally ground, overlapped with the frame view from upper side.

Also, as lens edge side view, it is possible to display the side view of the eyeglass lens L which is finally ground as shown in FIG. 13, and the sectional view of the rim of the eyeglass frame MF (the sectional view of the left and right lens rims LF(RF), matched to the V-shaped apex position YT.

Also, in order to input the magnitude of the L tilt, when it is needed to move to the front or behind direction by several mm with reference to the V-shaped YM of the L tilt item, the L tilt item is displayed, and 2 mm is input to the behind the direction (+ direction) with reference to the V-shaped YM.

Then, the V-shaped locus of the eyeglass lens which are finally ground is displayed in the form tilted from the standard position or in the form with the position changed on the screen, as shown FIGS. 12, 14 and 15. As described above, the present embodiment determines at the first time the reference axis (Rv(Lv) in FIG. 14 and RLh in FIG. 15) which becomes the reference when the V-shaped locus is tilted, shows the tilt form wherein the V-shaped locus moves from the standard position (YCR and YCL in FIG. 12), and looking at the edge side display (V-shaped simulation), increase or decreases the tilt amount of the V-shaped locus. Also, at the view from upper side of the eyeglass lens, which is finally ground, and the lens edge side view, the angle of the tilt form (indicated how apart it is by the arrow) of the optical axis of the eyeglass lens which is finally ground and the center position of the pupil of the person who wears the eyeglass is also displayed.

[Second embodiment]

FIGS. 16 to 34 shows the second embodiment of the present invention.

In the second embodiment of the present invention, the constitutions as shown in FIGS. 1 to 11 of the first embodiment are also used. The construction and operation other than the V-shaped tilt processing in the second embodiment of the present invention are the same as those of the first embodiment of the present invention. Therefore, the portion only about the control of the V-shaped tilt process by the arithmetic/judgment circuit 91 will be described later.

(v) Example 1 of the V-shape tilt processing

FIGS. 16 to 23 shows an example 1 (the first example) of the second embodiment of the present invention.

1. The initial setting

Figure 16A:
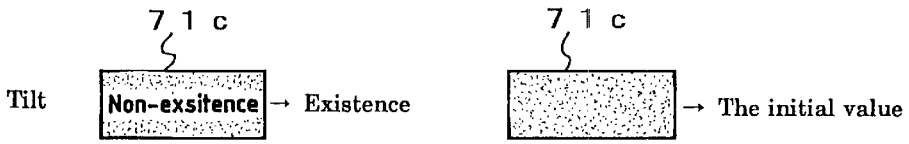
FIG. 16(*a*) is a view or explaining a portion of a screen changing the initial setting of a liquid crystal panel shown in FIG. 16(*b*).
Figure 16B:
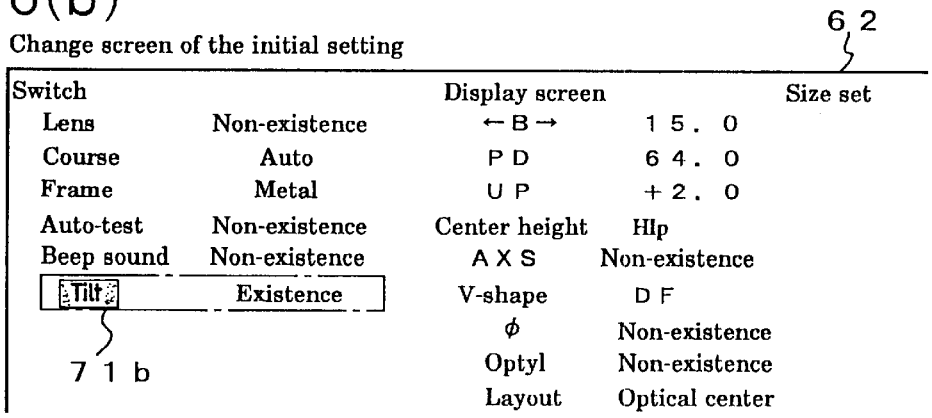

As shown in FIG. 16(*b*), in a setting change mode, the tilt mode is selected and set by fitting the cursor 71*b* to the item "Tilt" by the "+", "−" switches.

Figure 17A:
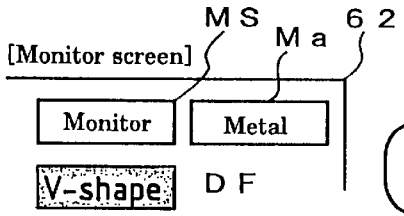
FIG. 17(*a*) is a view for explaining a portion of a tilt screen of a liquid crystal panel shown in FIG. 17(*b*).
Figure 17B:
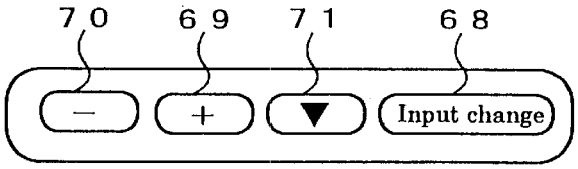
Figure 17C:
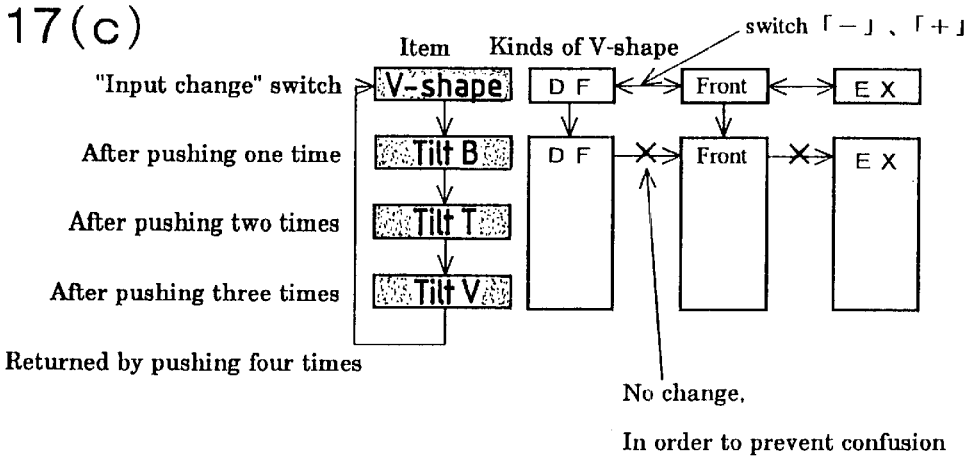
Figure 18A:
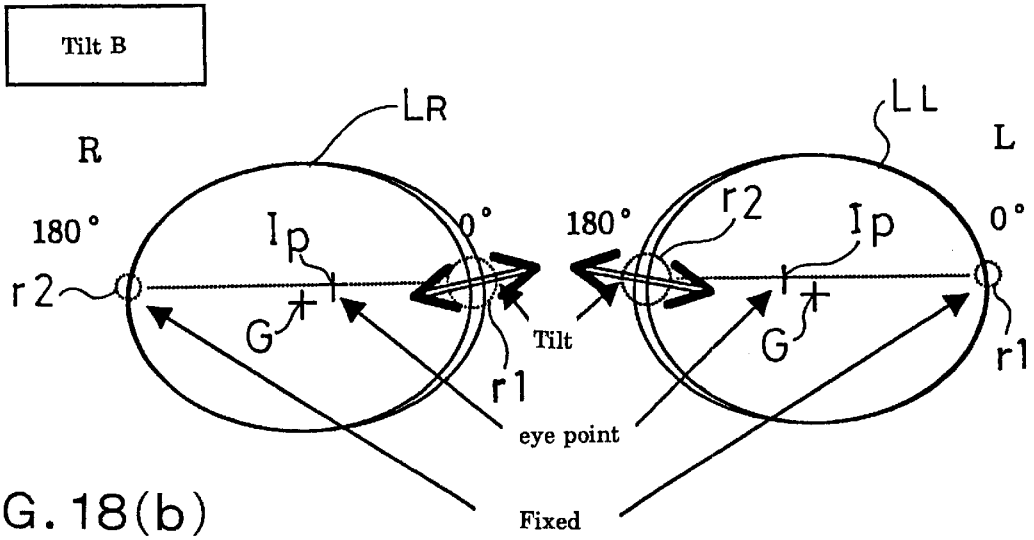
FIGS. 18(*a*) to 18(*c*) are views for explaining 'tilt mode' type.
Figure 18B:
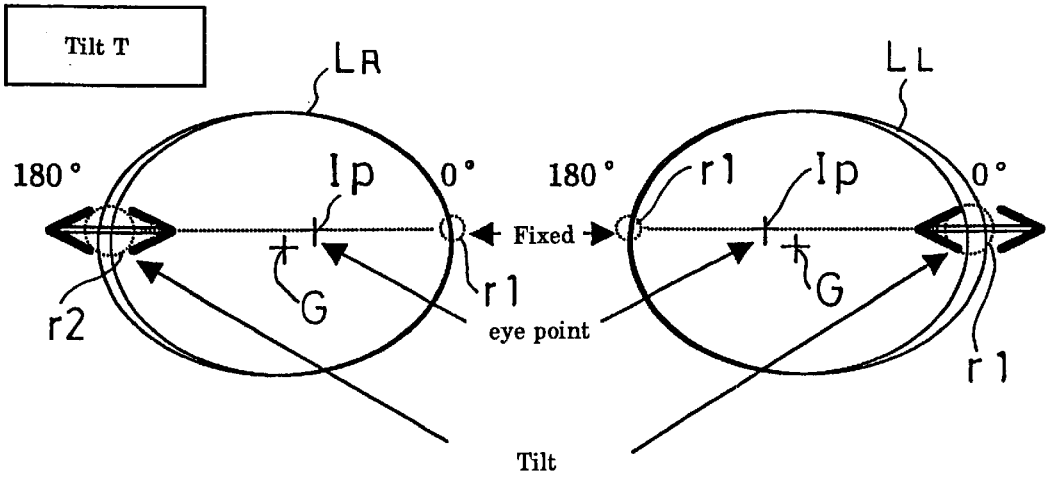
Figure 18C:
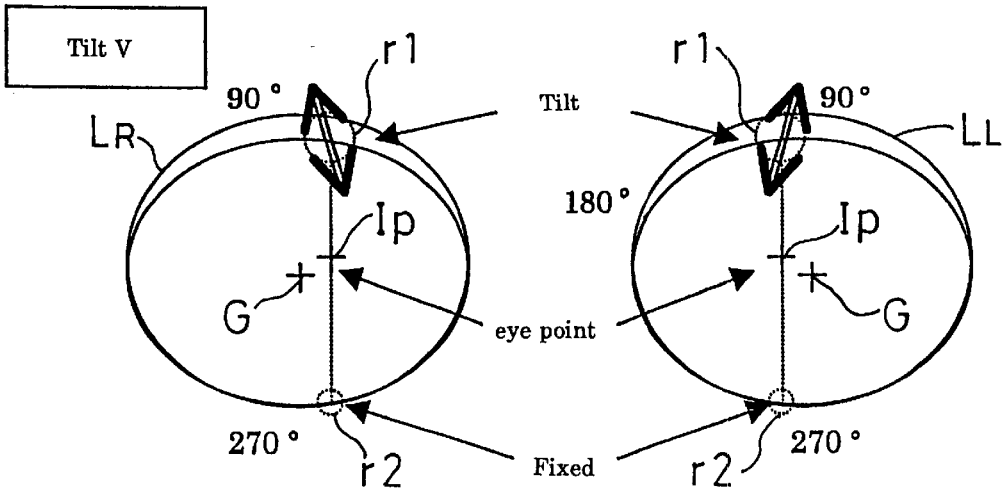

When the tilt mode is selected, the set mode at this time is initially displayed. In the tilt items shown FIG. 16(*a*), there is the cursor 71*c* of the black border at the place of "the non-existence" (for convenience, gray color in the drawings), and it can be moved between the non-existence and the existence. Also, the black border indicates the setting of the initial value, 2. Operating method of the tilt V-shape 2-1 Selecting and determining the tilt in FIG. 16(*a*), the tilt mode screen is displayed as shown in FIG. 17(*a*). In the above monitor screen shown in FIG. 17(*a*), the operation is carried out by fitting the cursor to the item "V-shape", and pushing "the input change" switch 68 of the keyboard 61.

Whenever the input change switch is pushed, the operation in which the items "V-shape", "Tilt B", "Tilt T" and "Tilt V" of FIG. 17(*c*) are sequentially changed is carried out.

The items "DF", "FRONT", "EX" can be selected by the operation of the "+", "−" switches 69, 70. The item "DF" means the ratio of the V-shape position (the ratio V-shape) on the edge surface. The item "FRONT" means that the V-shape is set by being fitted to the front surface curve of the eyeglass lens, and the item "EX" means the V-shape setting of the special lens such as a bifocal lens 7 or progressive multi-focal lens, etc.

[Tilt Mode]

When the respective tilt mode is selected, the tilt reference axis for determining the desired tilt directions is automatically set. The tilt reference axis of the respective tilt mode is as follows (See FIGS. 18(*a*), (*b*), (*c*)).

Tilt B: tilt the side of a nose (the side of ears is set as a reference)

The tilt reference axis is automatically set in a horizontal direction (0°–180° direction).

Tilt T: tilt the side of ears (the side of a nose is set as a reference)

The tilt reference axis is automatically set in a horizontal direction (0°–180° direction).

Tilt V: tilt the side of eyebrows (the reference is set to be right under PD)

The tilt reference axis is automatically set in a vertical direction (90°–270° direction).

The tilt reference axis passes through the eye point.

Figure 19:
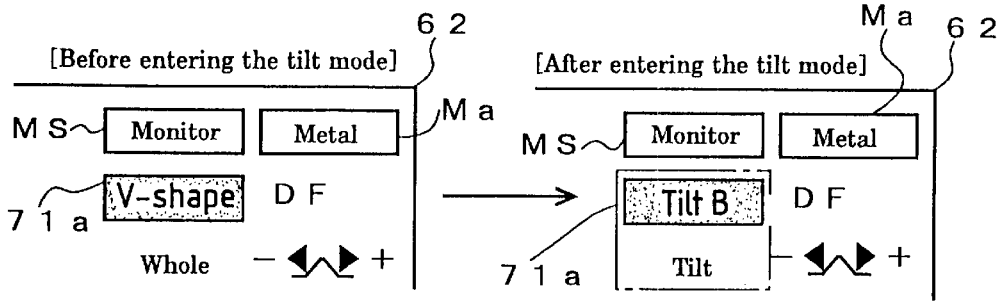
FIG. 19 is a view for explaining the liquid crystal panel shown in FIG. 12 before and after inputting 'tilt mode'.

FIG. 19 shows the modes before and after the tilt mode in the left and right portion, respectively.

At the same time that the tilt mode is set as "Tilt B", "Tilt T", "Tilt V", the display of one lower part item "Whole": ("Thick"/"Thin") is automatically changed into the item "Tilt" for inputting the tilt amount.

Then, whenever the input change switch is pushed, the function is changed as follows.

Figure 20:
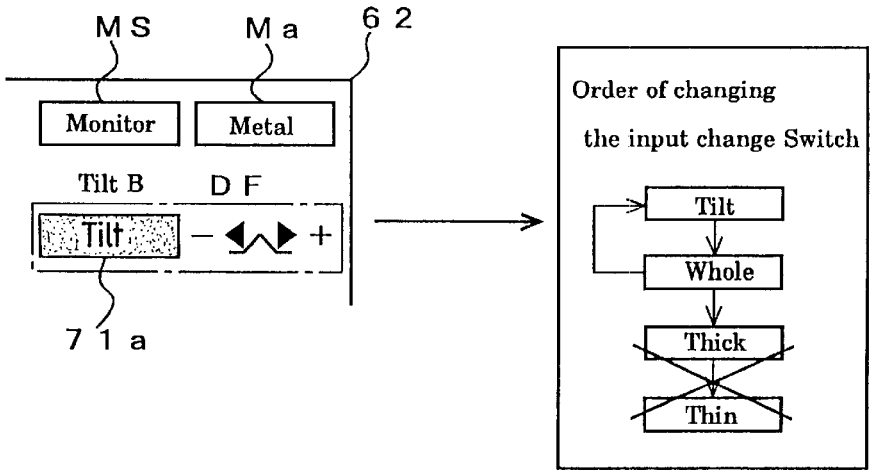
FIG. 20 is a view for explaining the liquid crystal panel shown in FIG. 19 after inputting 'tilt mode'.

As shown in FIG. 20, if the input change switch 68 is pushed in the tilt B, T, V modes, the tilt mode is changed between "Tilt" and "Whole" of the right side. Here, "Tilt" and "Whole" mean the followings.

Tilt: Inputting the tilt amount and tilting the V-shape.

Whole: Moving the whole of the V-shape by a constant amount.

The V-shape position change of the "Thick" and "Thin" can prevent the operation confusion. For that reason, in case of changing the curve (the ratio calculation), the V-shape curve adjustment is perfumed by changing the V-shape position of the "Thick" and "Thin" before entering the tilt mode.

Figure 21:
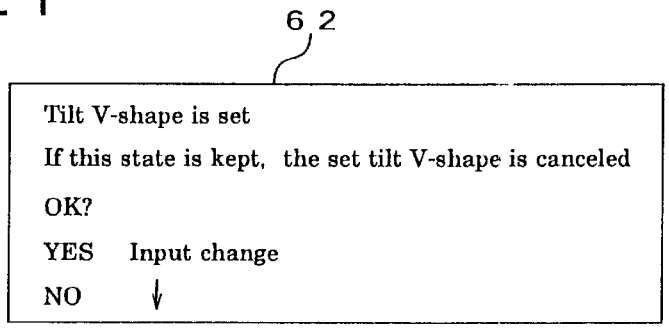
FIG. 21 is a view for explaining the liquid crystal panel shown in FIG. 20 after changing the tilt amount.

Changing once tilted V-shape into another tilt mode, the tilted V-shape is reset, and returned to be the state before the tilt. At this time, the message appeared in the screen shown in FIG. 21 is displayed.

2-2. Input of the tilt amount

Next, as shown in FIG. 22(*a*) and FIG. 22(*b*), when the cursor is fitted to the item "Tilt", the lens rim contour LR (or LL) is displayed at the left side portion of the liquid crystal panel 62, the contour of the upper edge end ULR (or ULL) (the contour of the upper edge surface) of the lens rim contour LR (or LL) is displayed at the upper side of the lens rim contour LR (or LL), and the contour of the lower end LLR (or LLL) (the contour of the lower edge surface) of the lens rim contour LR (or LL) is displayed at the lower side of the lens rim contour LR (or LL). Also, at this time, a minimum edge thickness contour k2', a maximum edge thickness contour r1' in an edge position to be tilted of the lens rim contour LR (or LL) are displayed, in the center portion of the liquid crystal panel 62. Further, a mark (or a figure) YM which indicates the V-shaped position is displayed in any portion on upward of the edge thickness contour k3'. In FIG. 22(*b*), the mark which indicates the V-shaped position is given as a triangle, however, it is apparent that other selection of symbols can be employed for it.

Also, the cursor K1 shown in a black square indicates the maximum edge position, the V-shape position YC1 tilted by the tilt processing is shown by a dashed line. Similarly, the cursor K2 shown in a black square indicates the minimum edge position, the V-shape position YC2 tilted by the tilt processing is shown by a dashed line. Furthermore, the cursor K3 shown by cross shape indicates any (middle) edge position, the V-shape position YC3 tilted by the tilt processing is shown by a dashed line.

Also, reference character Y denotes V-shape of the edge thickness contours k1', k2' and k3', and reference character Yt denotes the V-shape apex of the V-shaped Y. Thereafter, the reference characters denoted as the minimum edge thickness contour k2', the maximum edge thickness contour k1', the edge thickness contour k3' in any position, the edge thickness contour r1' in an edge position to be tilted, the V-shape Y, and the V-shape apex Yt, etc. correspond to the cursors K1, K2, K3, and r1 shown in FIGS. 23, 30, 31, and 32 as the same meanings, but those reference characters are omitted in FIGS. 23, 30, 31 and 32 to meet the convenience of the explanation. Also, the reference characters YCR (YCL) denote the V-shaped curve of the right side lens rim contour LR (or the left side lens contour LL), the V-shaped curve YCR (YCL) before the tilt is shown by a solid line, and the V-shaped curve YCR (YCL) after the tilt is shown by a dashed line.

Figures 22A, 22B:
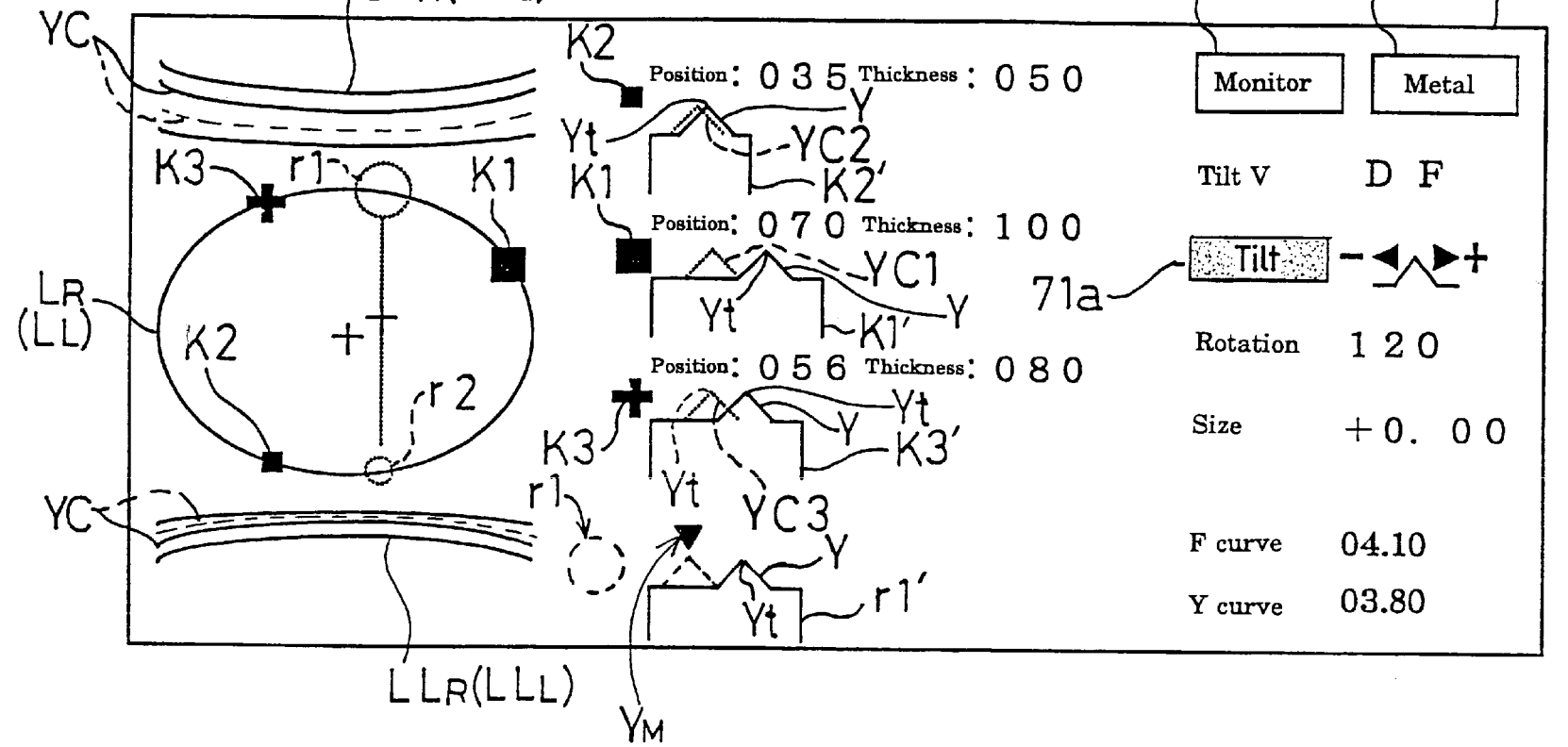
FIG. 22(*a*) is a view for explaining a portion of a tilt screen of the liquid crystal panel shown in FIG. 22(*b*).

The tilt operation of the present embodiment is performed by fitting the cursor to a "Tilt" mode by the "+", "−" switches (key), inputting the forward-backward moving amount of the V-shape, and thereafter tilting the V-shape in a desired position to overlap the apex of V-shaped Yt on the mark (or figure) as shown in FIG. 22*b*. Also, the big circle r1 denoted by a dot line in the edge position to be tilted is shown, and the small circle r2 denoted by the dot line in the edge position serving as the tilt reference is shown.

Also, the side surface of the edge surface [the contour of the upper edge surface, that is, the upper edge end ULR (or ULL), the contour of the lower edge surface, that is, the lower edge end ULR (or ULL)] is the upper and lower portion of the lens rum contour, the edge thickness contour is shown on a surface by the upper line and lower line, and the locus of the V-shaped apex is shown by the center line [the V-shaped curve YCR (or YCL)]. And, as the V-shape position is tilted, the above locus of the V-shape apex is also moved and displayed.

By doing so, the tilt V-shape operation (the tilt operation of the V-shape) is performed. Also, the tilt V-shape operation indicates an operation predetermining the position to be a tilt (inclining) reference, thereby adding and subtracting the tilt amount (the inclining amount) with looking at the 180° opposite position of the lens rim center from the above reference position.

2-3. Adjustment of the whole position

Figures 23A, 23B:
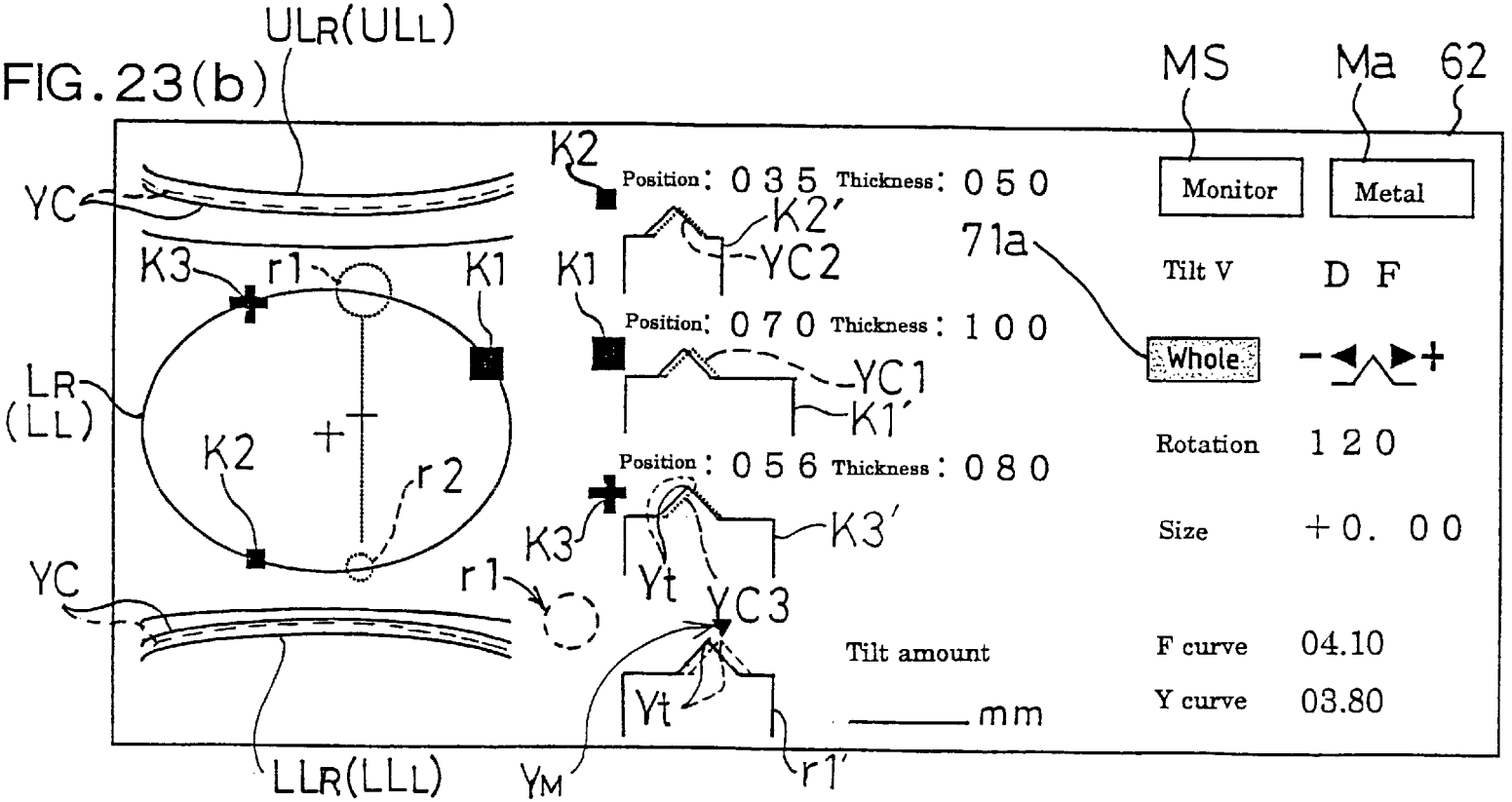
FIG. 23(*a*) is a view for explaining portion of a tilt screen of the liquid crystal panel shown in FIG. 23(*b*).
Figure 26:
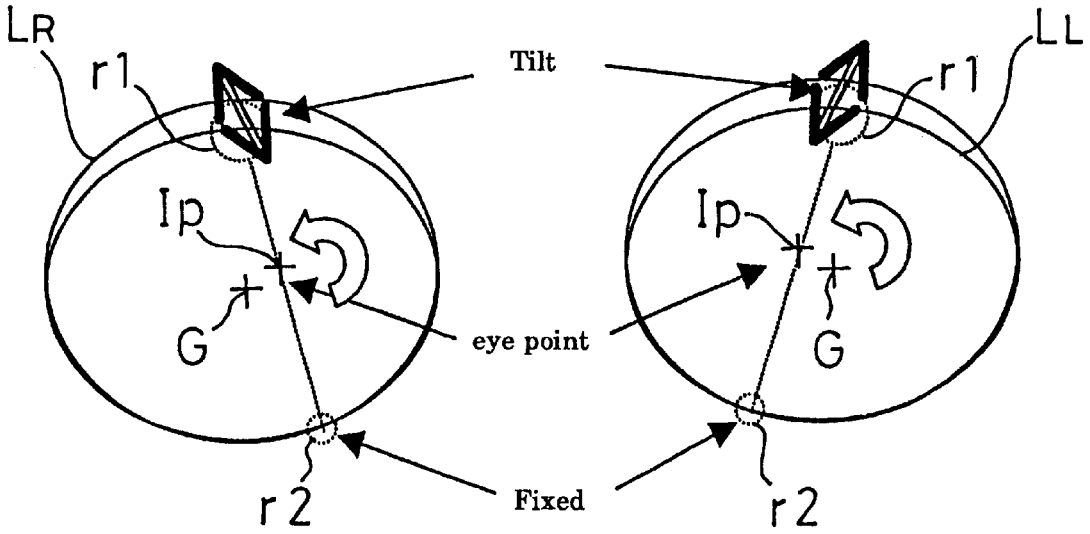
FIG. 26 is a view for explaining a tilt operation.

In FIG. 23, in a state that the cursor is fitted to the item "Tilt", the item "Tilt" is changed as the item "Whole" by pushing the input change switch. The V-shape position is adjusted by means of the "+", "−" switches. By the same manners with FIG. 22(*b*), the tilt operation is also performed.

(vi) Concrete example 2 of the V-shape tilt processing

FIGS. 24 to 32 show an example 2 (the second example) of the second embodiment of the present invention.

1. The initial setting

As shown in FIG. 24(*b*), in a setting change mode, the tilt mode is selected and set by fitting the cursor 71*b* to the item "Tilt" by the "+", "−" switches.

When the tilt mode is selected, the set mode at this time is initial displayed. In the tilt item shown FIG. 24(*a*), there is the cursor 71*c* of the black border at the place of "the non-existence", and it can be moved between the non-existence and the existence. Also, the black border indicates the setting of the initial value.

2. Operating method of the tilt V-shape 2-1. Selecting and determining the tilt in FIG. 24(*a*), the tilt mode screen is displayed as shown in FIG. 25(*a*). In the above monitor screen shown in FIG. 25(*a*), the operation is carried out by fitting the cursor to the item "V-shape", and pushing "the input change" switch 68 of the keyboard 61.

Whenever the input change switch is pushed, the operation in which the items "V-shape" and "Tilt A" of FIG. 25(*c*) are sequentially changed is carried out. The items "DF", "FRONT" and "EX" can be selected by the operation of the "+", "−" switches 69, 70. The item "DF" means the ratio of the V-shape position (the ratio V-shape) on the edge surface. The item "FRONT" means that the V-shape is set by being fitted to the front surface curve of the eyeglass lens, and the item "EX" means the V-shape setting of the special lens such as a bifocal lens 7 or progressive multi-focal lens, etc. The item "Tilt A" is, as shown FIG. 26, the mode indicating that the tilt reference axis for determining the desired tilt direction can be freely set in the overall circumference direction (0° to 360°). Also, the tilt reference a passes through the eye point.

Figure 27:
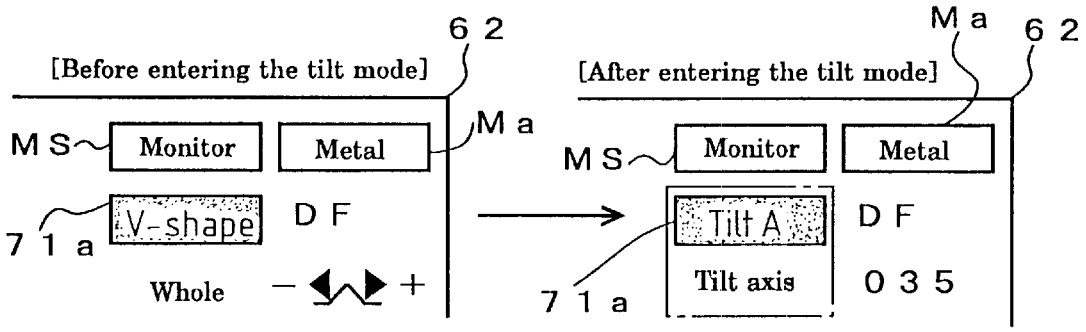
FIG. 27 is view for explaining another example of the liquid crystal panel shown in FIG. 12 before and after inputting 'tilt mode'.

FIG. 27 shows the modes before and after the tilt mode in the left and right portions, respectively.

At the same time that the tilt mode is set as "Tilt A", the display of one lower part item "Whole":("Thick"/"Thin") is automatically changed into the item "Tilt axis" for inputting the tilt amount.

Then, whenever the input change switch is pushed, the function is changed as follows.

Figure 28:
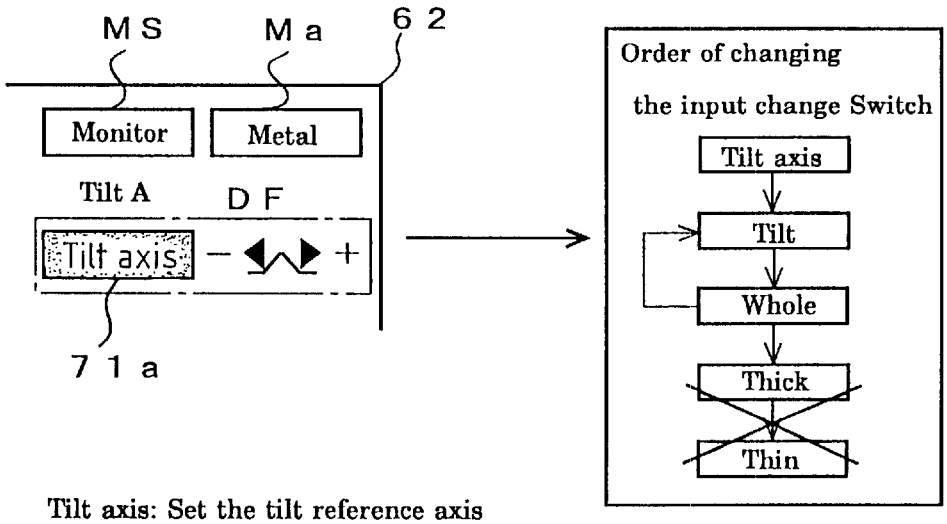
FIG. 28 is a view for explaining the liquid crystal panel shown in FIG. 27 after inputting 'tilt mode'.

As shown in FIG. 28, if the input change switch 68 is pushed in the tilt A mode, the tilt mode is changed between "Tilt" and "Whole" of the right side. Here, "Tilt axis", "Tilt" and "Whole" set the tilt axis: the tilt reference axis Tilt: Inputting the tilt amount and tilting the V-shape.

Whole: Moving the whole of the V-shape by a constant amount.

The V-shape position change of the "Thick" and "Thin" can prevent the operation confusion. For that reason, in case of changing the curve (the ratio calculation), the V-shape curve adjustment is performed by changing the V-shape position of the "Thick" and "Thin" before entering the tilt mode.

Figure 29:
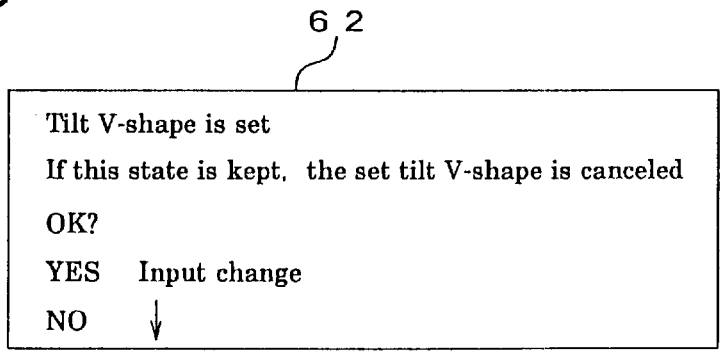
FIG. 29 is a view for explaining the liquid crystal panel after changing the tilt amount shown in FIG. 28.

After once setting the tilt axis, the respective tilt amount is changed by changing "Tilt" into "Whole". In order to change the tilt axis again, the V-shape is returned to be the normal V-shape by fitting the or 71*a* to the item "Tilt A" and pushing the input change switch. The titled V-shape is reset and returned to be the state before the tilt. At that time, the message appeared in the screen shown in FIG. 29 is displayed.

2-2. Setting of the tilt reference

Figures 30A, 30B:
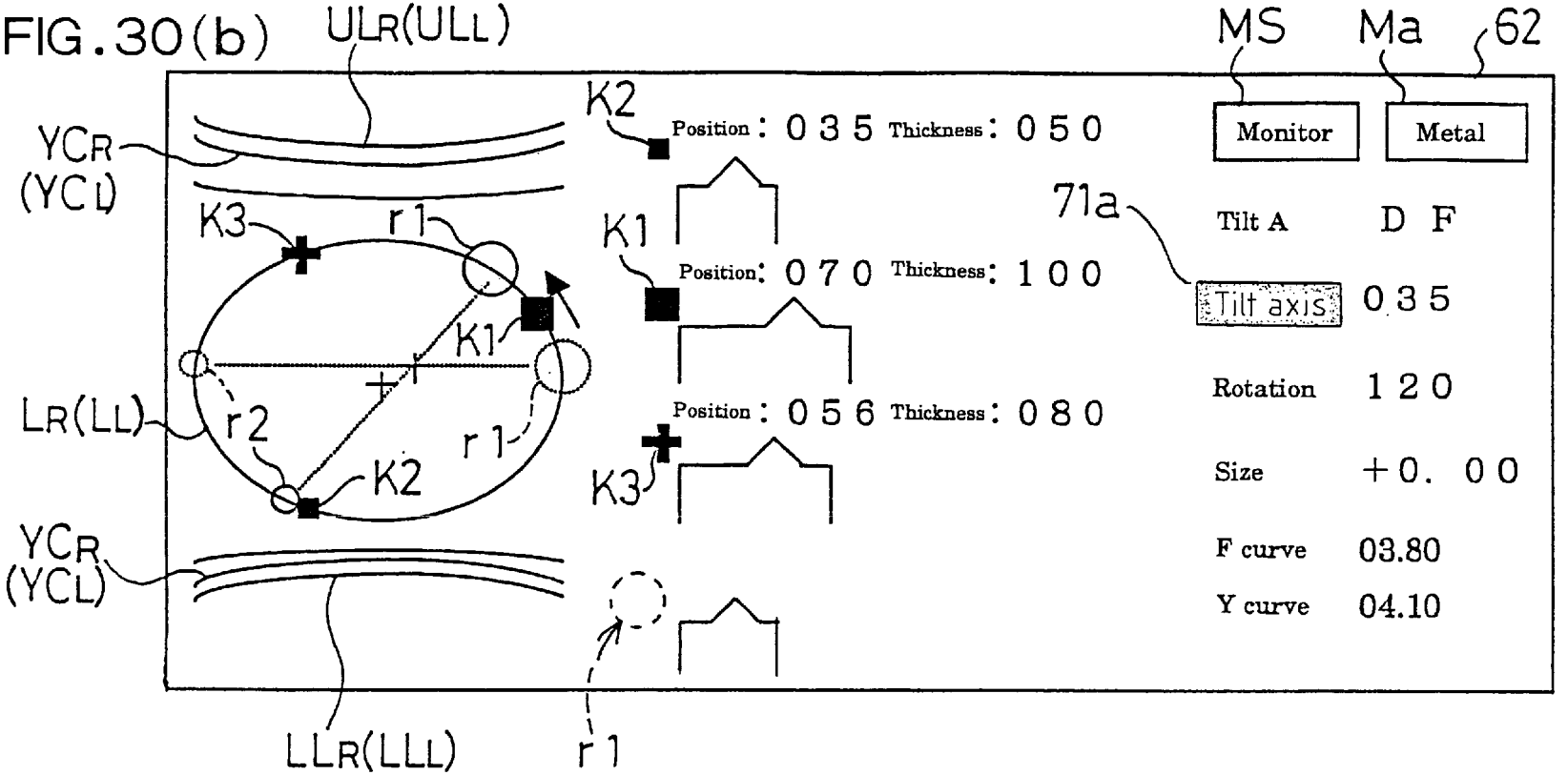
FIG. 30(*a*) is a view for explaining the tilt screen of the liquid crystal panel shown in FIG. 30(*b*).
Figures 31A, 31B:
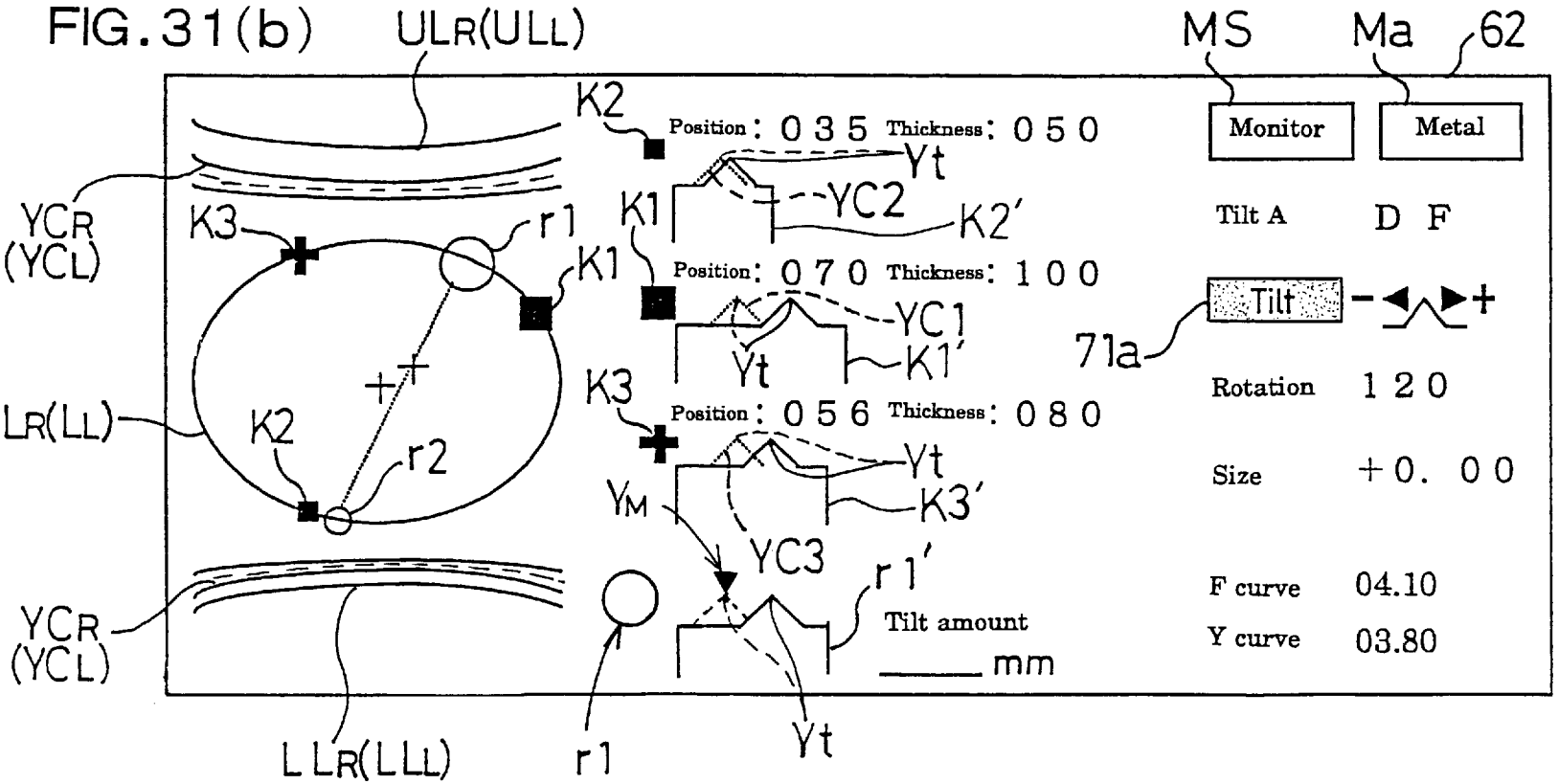
FIG. 31(*a*) is a view for explaining the tilt screen of the liquid crystal panel shown in FIG. 31(*b*).

Next, as shown in FIG. 30(*a*), the desired tilt axis is set by changing an angle value by the "+", "−" switches, in a state that the cursor is fitted to the item "Tilt axis". The tilt reference axis can be set every 5° at the whole circumference. Also, the big circle r1 denoted by a dot line in the edge position to be tilted is shown, and the small circle r2 denoted by the dot line in the edge position serving as the tilt reference is shown. Also, the cursor K1 shown in a black square indicates a maximum edge position, and the V-shape position YC1 tilted by the tilt processing is shown by a dashed line, as shown in FIG. 31(*b*). Similarly, the cursor K2 shown in a black square indicates a minimum edge position, the V-shape position YC2 tilted by the tilt processing is shown by a dashed line. Furthermore, the cursor K3 shown in cross shape indicates any (middle) edge position, and the V-shape position YC3 tilted by the tilt processing is shown by a dashed line.

(Input of the tilt amount)

The tilt operation of the present embodiment is, as "fitting the cursor to the time "Tilt" described with reference to FIG. 22(*a*), performed by fitting the cursor 71*a* to the item "Tilt" on the liquid crystal panel 62 in FIG. 22(*b*). In this state, in order to input the forward and backward moving amount of the V-shape the "+", "−" switches are operated and tilt the V-shape in a desired position to overlap the apex of V-shaped Yt on the mark YM.

Also, the big circle r1 denoted by a dot line in the edge position to be tilted is shown, and the small circle r2 denoted by the dot line in the edge position serving as the tilt reference is shown. The cursor K1 shown in a black square indicates a maximum edge position, and the V-shape position YC1 tilted by the tilt processing is indicated by a dashed line. Similarly, the cursor K2 shown in a black square indicates a minimum edge position, and the V-shape position YC2 tilted by the tilt processing is shown by a dashed line. Furthermore, the cursor K3 shown in cross shape indicates any (middle) edge position, and a dashed line shows the V-shape position YC3 tilted by the tilt processing.

Also, the V-shape position YC4 in the big circle r1 denoted by a dot line in the edge position to be tilted can be shown to appear by a dashed line, and the tilt amount can be input while watching the V-shape sectional contour. Also, as shown in FIGS. 23(*b*) and 31(*b*), the tilt amount can be displayed in numerical value (mm as a unit) on the liquid crystal panel 62, by positioning at the side of the edge end contour r1' (including the V-shape contour) in the portion of a circle r1 on the liquid crystal panel 62.

(Adjustment of the whole position)

Figures 32A, 32B:
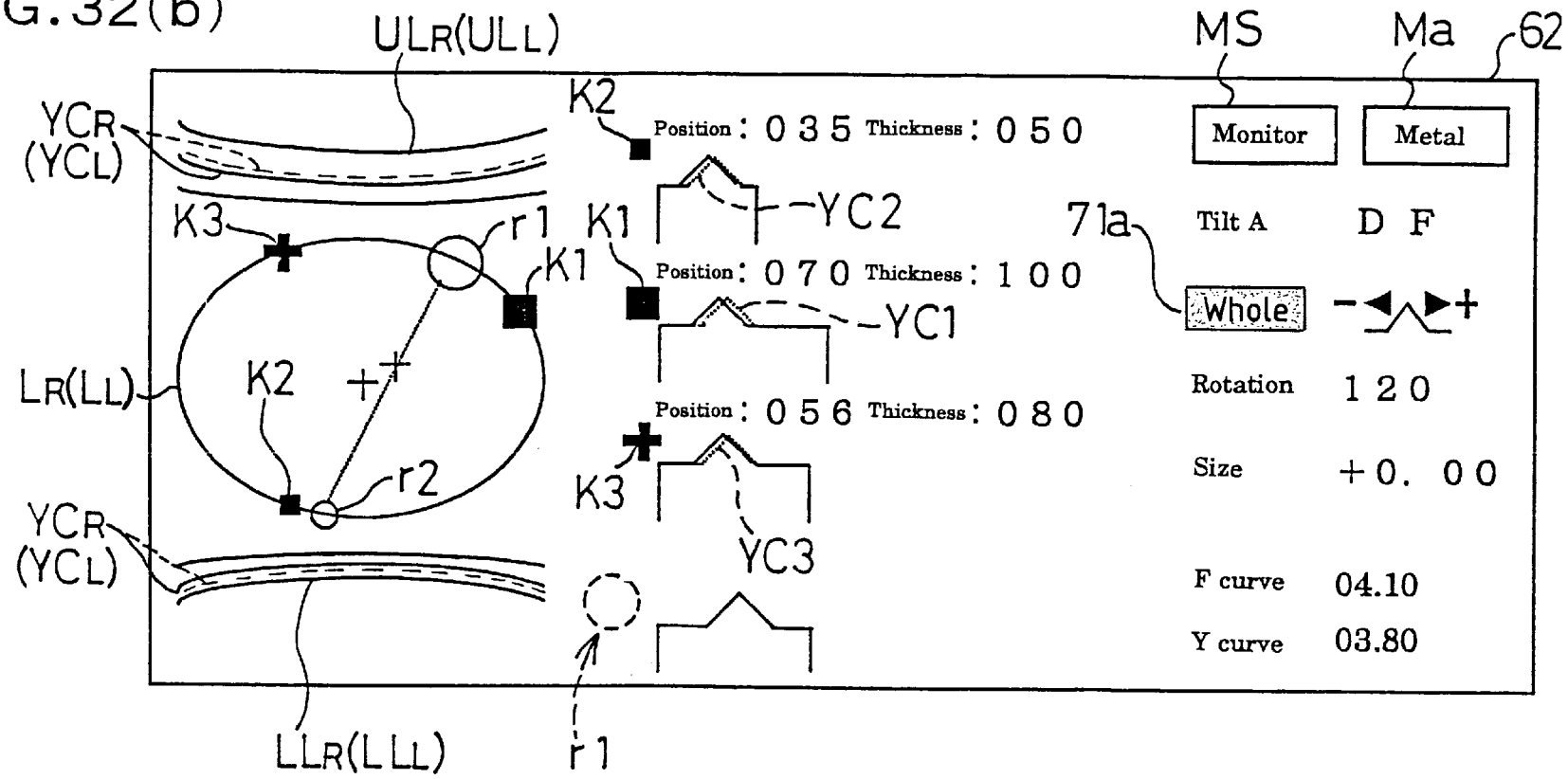
FIG. 32(*a*) is a view for explaining the tilt screen of the liquid crystal panel shown in FIG. 32(*b*).

In FIG. 32, in a state that the cursor is fitted to the item "tilt", the input change switch is pushed to change the item to "Whole". The "+" and "−" switches are used to adjust the V-shaped position. Also, the tilt operation is conducted in the same manner of FIG. 22(*b*) and FIG. 31. In this embodiment the mark YM indicating the V-shaped position is displayed in the tilt operation (input tilt amount), however, it is also apparent that the mark YM indicating the V-shaped position can be displayed when adjusting the V-shaped position and whole edge position is moved from the position denoted by solid line to the position denoted by dotted line and adjusted to overlap the apex of V-shaped Yt on the mark YM as shown in FIG. 32(*c*).

(vii) Principle of the tilt V-shape

Figure 33A:
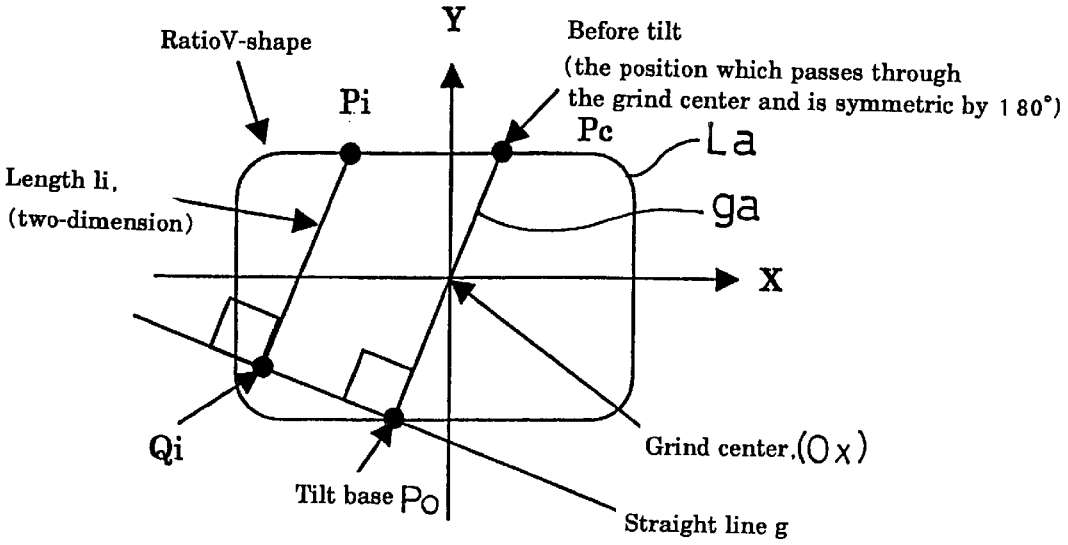
FIGS. 33(*a*) to 33(*c*) are views for explaining a principle of the tilt operation.
Figure 33B:
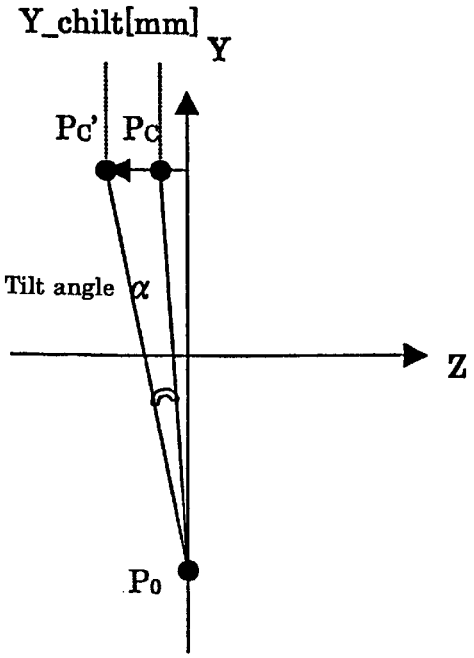
Figure 33C:
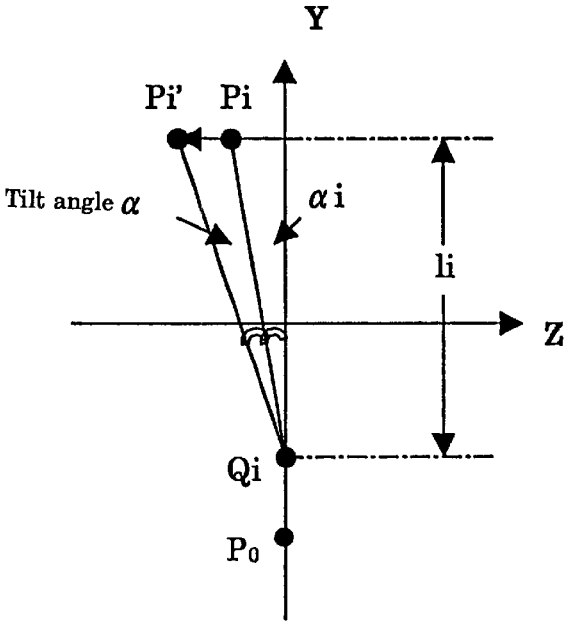
Figure 34:
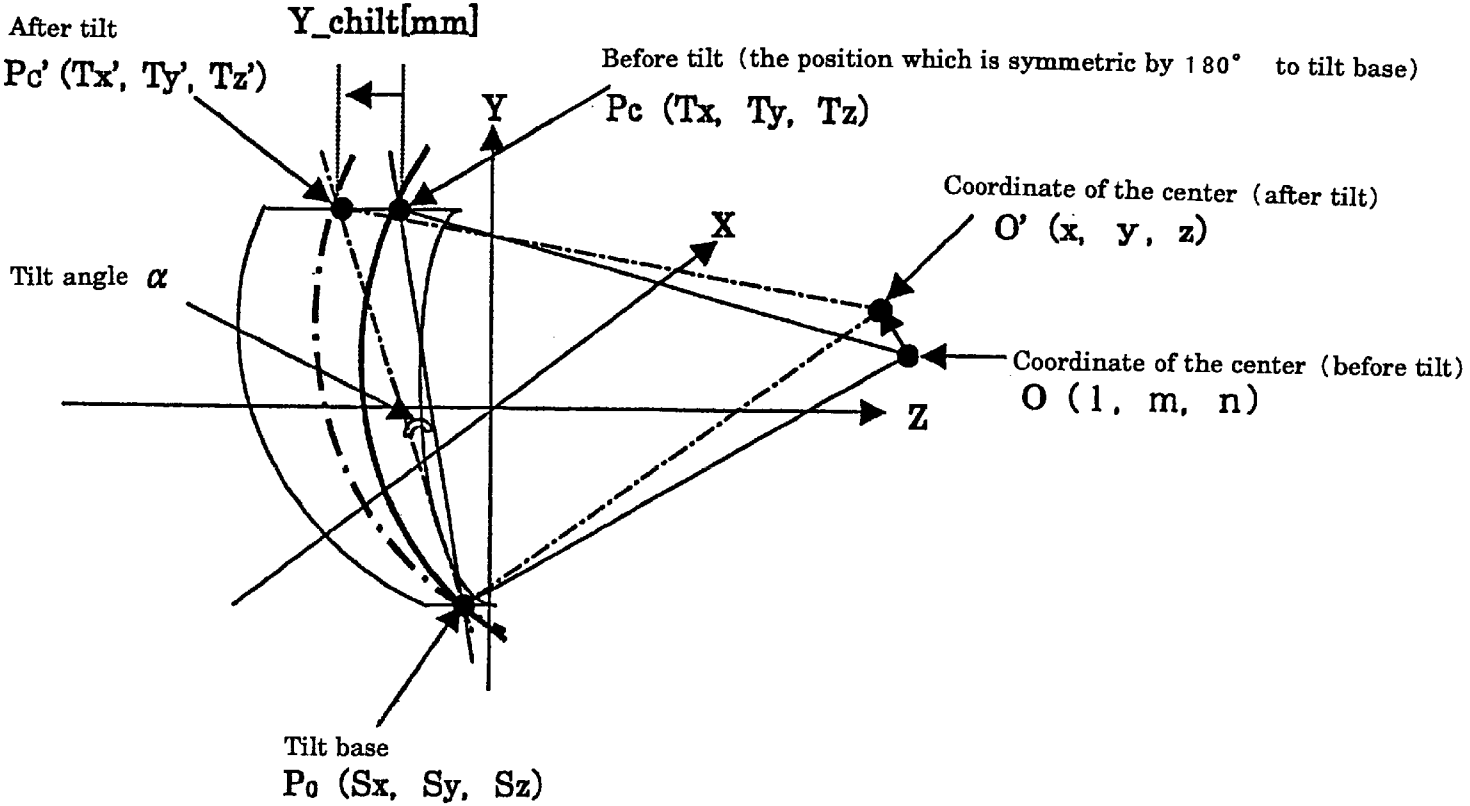
FIG. 34 is a view for explaining the principle of the tilt operation.

FIG. 33 and FIG. 34 show the principle of the tilt V-shape (in order to tilt the V-shape) according to the second embodiment of the invention.

FIG. 33(*a*) shows the schematic contour of the lens rim contour La (eyeglass lens contour), P0 denotes the tilt reference point at any edge thickness position, and li denotes the length between the points Pi and Qi. In said drawings, if the straight line, which passes through the tilt reference point P0 and grind center Ox (the center of the pupil of the eye) is ga, point Pc becomes to be set. This point Pc is the point to be tilted. Also, the straight line g, which passes through the tilt reference point P0 and is perpendicular to the straight line ga, is obtained. The Pi is any point on the lens rim contour La, and Qi is a point that passes through the point Pi and is perpendicular to the straight line g. The tilt is conducted on the basis of the straight line g. That is, the straight line g becomes the tilt axis. FIGS. 33(*b*) and (*c*) show the state to be tilted (the lens rim contour La and the points Pi and Pc are rotationally moved or rotated) based on the straight-line g. In FIG. 33(*c*), the tilt angle in the initial state of the point Pi is ready set to α i. In FIG. 33(*c*), the tilt angle to be tilted based on the straight-line g is displayed as α.

In the FIGS. 33(*a*) to 33(*c*), the tilt angle α is calculated from the cosine theory since it is divided into three points P0, Pc, and Pc'.

$$\cos\alpha=(|P0Pc|2+|P0Pc'2-|PcPc'|2)/2|P0Pc||P0Pc'|)$$

If the Z coordinate of the tilt point is, for example, Z=0, the Z coordinate of each point after tilt process are as follows;

$$\therefore Zi'=li\cdot\tan(\alpha+\alpha i),\ Zi=li\cdot\tan\alpha i$$

li: the straight line which is perpendicular to the straight line connecting the 2 dimensional distance Pc and P0 of the straight line connecting the point Pi and Qi on the XY plane and passes through the point P0, is the straight line g.

The point, which is parallel to the straight line PcP0 from Pi on XY plane and crosses the straight line g, is Qi. Also, i is [i=1, 2, 3, . . . n].

(viii) Another principle of the V-shape tile

FIG. 34 shows a method for calculating the spherical surface curve at four points on the V-shape obtained with the ratio. Also, the V-shape obtained with the ratio (ratio calculation) means that the V-shaped is obtained by determining the ratio of the distance from the front side refraction surface to the V-shaped apex of the eyeglass lens at the edge end and the distance from the rear side refraction surface to the V-shaped apex.

The coordinates of three points P0, 0, Pc shown by P0 (Sx, Sy, Sz), 0(l, m, n) and Pc (Tx, Ty, Tz) are considered in the same plane, the triangle formed by the three points P0, 0, Pc is rotated by an angle α based on the point P0 as the triangle formed by the three points P0, 0', Pc' in FIG. 34.

The coordinates (x, y, z) of the sphere center 0' rotated by the angle α are obtained, and Z coordinate corresponding to new spherical surface curve is calculated.

(iX) Method for calculating the spherical surface curve 1. Determine a plurality of points needed to calculate the curve from the lens rim contour data ρ.

(Method for determining point)

Obtain at least four points on the lens rim contour most suitable to calculate the curve from the lens contour data. This example will be explained with reference to the four points most suitable to calculate the curve. 2. The apex position of the V-shape obtained by the ratio calculation is considered as the coordinates Pi (Xi, Yi, Zi) of the four points most suitable to calculate the predetermined curve. Here, i=1, 2, 3, 4.

3. Obtain the solution of the sphere equation at the four points. That is, the curve ratio radius r of the apex point of the V-shape is obtained from the coordinates Pi (Xi, Yi, Zi) of the four points and the center coordinates l, m, n). Sphere equation: (Xi+1)2+(Yi+m)2 +(Zi+n)2 =r2

4. Convert the obtained curve ratio radius r into a curve CV.

CV=a[mm]/r[mm]

Also, according to the present invention, in case of the constitution comprising an input means of lens rim contour data for inputting left/right lens rim contour data of an eyeglass frame in third dimension; a calculating means for calculating, based on the inputted lens rim contour data, an angle of inclination of lens rim contour in either left or right eye of eyeglass frame to lens rim of the other eye; and a display means for display a type of inclination of left/right lens rim of an eyeglass frame, based on the calculated angle, as a view from upper or lower side of the eyeglass frame, the contours of the eyeglass frame and the eyeglass lens rim related to three dimensional virtual display (3D V-shaped simulation), and a V-shaped locus formed in an edge surface of lens can be grasped in three dimensions and assembling of the virtual frame can be visually represented.

Also, in case of the constitution in which a side view of eyeglass lens assembled in the lens rim of the eyeglass frame, after finish grinding, is displayed corresponding to the type of inclination of the left and right lens rims of the eyeglass frame on the same screen from upper side or lower side of the eyeglass frame, the assembling of the virtual frame can be predicted previously in the upper side surface or the lower side surface of the eyeglass so that an grinding data of the eyeglass lens fitting the eyeglass frame is obtained.

In case of the constitution illustrating based on pupil distance(PD) data of eyeglass wearer, a direction of eye in a state of long distance, it can be recognized at a look that the pupil distance PD data of eyeglass wearer's eye has the size of a certain extent for an actual curved eyeglass frame.

In case of the constitution illustrating an optical axis direction of eyeglass lens assembled in the lens rim of the eyeglass frame, a deviation angle between the pupil distance (PD) data of eyeglass wearer's eye and the optical axis direction of the eyeglass lens can be recognized at a look so that it can make certain of a difference between a true PD data and a nominal PD data.

In case of the constitution displaying a front view of the lens rim contour data of the eyeglass frame on the same screen, a contour of a cross side in the eyeglass lens can be recognized.

In the apparatus for displaying lens contour, in case of the constitution displaying a cross side view of the eyeglass lens assembled in the eyeglass frame on the same screen, the extent of an inclination to a left/right lens rims of the eyeglass frame can be recognized quantitatively.

In case of the constitution displaying an inclined angle of the lens rim of the eyeglass frame, a deviation angle between the pupil distance (PD) data of eyeglass wearer's eye and the optical axis direction of the eyeglass lens can be recognized quantitatively so that it can make certain of a difference between a true PD data and a nominal PD data.

In case of the constitution displaying an inclined angle of the optical axis of the eyeglass lens to a pupil center of the eyeglass wearer's eye, a deviation angle between the pupil distance (PD) data of the eyeglass of the eyeglass wearer's eye and the optical axis direction of the eyeglass lens can be record quantitatively so that it can make certain of a difference between a true PD data and a nominal PD data.

In case of the constitution comprising lens rim contour input means for inputting lens rim of an eyeglass frame in three dimensions; an edge thickness contour data input means for inputting an edge thickness contour data of eyeglass lens to be assembled in a lens rim; a V-shaped figure data input means for inputting a V-shaped figure data related to V-shaped figure armed in an edge end surface of the eyeglass lens; and a calculating means for calculating, based on the inputted edge thickness contour data and the V-shaped figure data, an angle of inclination of an optical axis of the eyeglass lens to a pupil center of eyes wearer's eye after finish grinding, the contours of the eyeglass frame and the eyeglass lens related to three dimensional virtual display (3D V-shaped simulation), and a V-shaped locus formed in an edge surface of the lens can be grasped in three dimensions, and assembling of the virtual frame can be presented visually.

In case of the constitution an apparatus for processing lens contour data and further including a display means for displaying the calculated angle of inclination of the optical axis of the eyeglass lens to the pupil center of the eyeglass wearer's eye, a deviation angle between the pupil distance (PD) data of eyeglass wearer's eye and the optical axis direction of the eyeglass lens can be recognized quantitatively so that it can make certain of a difference between a true PD data and a nominal PD data.

In case of the constitution further comprising a display means for displaying the angle of inclination for the eyeglass lens to the pupil center of the eyeglass wearer's eye, a deviation angle between the pupil distance (PD) data of eyeglass wearer's eye and the optical axis direction of the eyeglass lens can be recognized quantitatively so that it can make certain of a difference between a true PD data and a nominal PD data.

In case of the constitution comprising the apparatus for processing lens contour data, a deviation angle between the pupil distance (PD) data of eyeglass wearer's eye and the optical axis direction of the eyeglass lens can be recognized quantitatively so that it can make certain of a difference between a true PD data and a nominal PD data, and at the same time, a grinding of the eyeglass lens fitted with the eyeglass frame can be realized.

In case of the constitution comprising lens rim contour data input means for inputting lens rim contour data of an eyeglass frame in three dimensions; an edge thickness contour data input means for inputting an edge thickness contour data of eyeglass lens to be assembled in a lens rim; a V-shaped figure data input means for inputting a V-shaped figure data related to V-shaped figure firmed in an edge end surface of the eyeglass lens; and a calculating means for setting, as a reference line of a desired incline direction, a straight line perpendicular to line which connects any edge position of the lens rim with an edge position having a relation of point symmetry to a pupil center of an eyeglass wearer's eye for the edge position, obtaining a V-shaped figure data for correction formed in the edge end surface of the eyeglass lens inclined desirably with the reference line in the center, the V-shaped figure data with high precision can be obtained because the V-shaped locus obtained by calculation fits better with the eyeglass frame.

In case of the constitution displaying a line connecting any edge position of lens rim with an edge position having a relation of point symmetry to a pupil center of an eyeglass wearer's eye for the edge position to overlap in the lens rim contour, because it can be known by which the V-shaped locus is inclined, the assembling of the virtual frame as desirable according to the preference of the eyeglass wearer can be recognized at a look.

In case of the constitution comprising the apparatus for displaying the lens contour data, the calculated V-shaped locus can be adjusted by desirably being inclined according to the preference of the eyeglass wearer, and a grinding of the eyeglass lens better fitted with the eyeglass frame can be realized on the basis of the V-shaped figure data.

As explained the above, by the apparatus for displaying lens contour in accordance with the present invention, the contours of the eyeglass frame and the eyeglass lens related to three-dimensional virtual display (3D V-shaped simulation), and a V-shaped locus formed in an edge surface of lens can be grasped in tree dimensions, and the assembling of the virtual frame can be presented visually.

In the apparatus according to the invention, the assembling of the virtual frame can be predicted previously in the upper side surface of the lower side surface of the eyeglass frame so that a grinding data of the eyeglass lens better fitted with the eyeglass frame can be obtained.

In the apparatus according to the invention, it can be recognized at a look that the pupil distance (PD) data of the eyeglass wearer's eye has the size of a certain extent for a curved eyeglass frame.

In the apparatus according to the invention, a deviation angle between the pupil distance (PD) data of the eyeglass wearer's eye and the optical axis direction of the eyeglass lens can be recognized at a look so that it can make certain of a difference between a true PD data and a nominal PD data.

In the apparatus according to the invention, a contour of a cross side surface in the eyeglass lens can be recognized.

In the apparatus according to the invention, the extent of an inclination to a left/right frame of the eyeglass frame can be recognized quantitatively.

In the apparatus according to the invention, a deviation angle between the pupil distance (PD) data of the eyeglass of the eyeglass wearer's eye and the optical axis direction of the eyeglass lens can be record quantitatively so that it can make certain of a difference between a true PD data and a nominal PD data.

In the apparatus according to the invention, a deviation angle between the pupil distance (PD) data of the eyeglass of the eyeglass wearer's eye and the optical axis direction of the eyeglass lens can be recognized quantitatively so that it can make certain of a difference between a true PD data and a nominal PD data.

In the apparatus according to the invention, the contours of the eyeglass frame and the eyeglass lens related to three-dimensional virtual display (3D V-shaped simulation), and a V-shaped locus formed in an edge surface of lens can be grasped in three dimensions, and the assembling of the virtual frame can be represented visually.

In the apparatus according to the invention, a deviation angle between the pupil distance (PD) data of the eyeglass wearer's eye and the optical axis direction of the eyeglass can be recognized quantitatively so that it can make certain of a difference between a true PD data and a nominal PD data.

In the apparatus according to the invention, a deviation angle between the pupil distance (PD) data of the eyeglass of the eyeglass wearer's eye and the optical axis direction of the eyeglass lens can be recognized quantitatively so that it can make certain of a difference between a true PD data and a nominal PD data.

In the apparatus according to the invention, a deviation angle between the pupil distance (PD) data of the eyeglass wearer's eye and the optical axis direction of the eyeglass can be recognized quantitatively so that it can make certain of a difference between a true PD data and a nominal PD data, and at the same time, a grinding of the eyeglass lens better fitted with the eyeglass frame can be realized. In the apparatus according to the invention, the V-shaped figure data with high precision can be obtained as the calculated V-shaped locus is better fitted with the eyeglass frame.

In the apparatus according to the invention, since it can be known by which basis the V-shaped figure is inclined, the assembling of the desirable virtual frame according to a preference of the eyeglass wearer can be recognized at a look.

In the apparatus according to the invention, the calculated V-shaped locus can be adjusted by being inclined as desirable according to the preference of the eyeglass wearer, and a grinding of the eyeglass lens better fitted with the eyeglass frame on the basis of the V-shaped figure data can be realized.

What is claimed is:

1. An apparatus for displaying a lens contour comprising:

a means for inputting data of a contour of right or left lens rim of an eyeglass frame in three dimensions;

a means for calculating an angle of inclination of one of right and left lens rims to the other lens rims, based on said inputted data; and a means for displaying the degree of inclination of the right or left lens rim of the eyeglass frame, based on said calculated results, as a side view from upper or lower side of the eyeglass frame, a side view of the eyeglass lens which is assembled in the lens rim of the eyeglass frame and which is finished being displayed on the same image surface as an upper or lower side view of the eyeglass frame, corresponding to the inclination of the right or left rim of the eyeglass frame.

2. The apparatus for displaying lens contour according to claim 1, wherein said apparatus displays a direction of eye in a state of long distance based on pupil distance (PD) data of an eyeglass wearer.

3. The apparatus for displaying lens contour according to claim 1, wherein said apparatus displays an optical axis direction of an eyeglass lens assembled in the lens rim of the eyeglass frame.

4. The apparatus for displaying lens contour according to claim 1, wherein said apparatus displays a front view of the lens rim contour of the eyeglass frame in the same picture.

5. The apparatus for displaying lens contour according to claim 4, wherein said apparatus displays a side view of an eyeglass lens assembled in the eyeglass frame in the same picture.

6. The apparatus for displaying lens contour according to claim 3, wherein said apparatus displays an inclined angle of the optical axis of the eyeglass lens to a pupil center of eye of an eyeglass wearer.

7. The apparatus for displaying lens contour according to claim 6, wherein said apparatus further comprises a display means for displaying the angle of inclination of the optical axis of the eyeglass lens to the pupil center of the eyeglass wearer's eye.

8. An apparatus for processing lens contour data, said apparatus comprising:

a lens rim contour data input means for inputting lens rim contour data of an eyeglass frame in three dimensions;

an edge thickness contour data input means for inputting an edge thickness contour data of eyeglass lens to be assembled in a lens rim;

a V-shaped figure data in put means for inputting a V-shaped figure data related to V-shaped figure formed in an edge end surface of the eyeglass lens; and a calculating means for calculating an angle of inclination of an optical axis of the eyeglass lens to a pupil center of an eyeglass wearer's eye finish grinding, based on the inputted edge thickness contour data and the V-shaped figure.

9. An apparatus for displaying lens contour comprising the apparatus for processing lens contour data according to claim 8, wherein said apparatus further comprises a display means for displaying the calculated angle of the inclination of optical axis of the eyeglass lens of the pupil center of the eyeglass wearer's eye.

10. An apparatus for grinding edge of eyeglass lens comprising the apparatus for displaying lens contour according to claim 9.

11. An apparatus for grinding edge of eyeglass lens comprising the apparatus for displaying lens contour according to claim 1 and apparatus for processing lens contour data of claim 8.

12. An apparatus for grinding edge of eyeglass lens comprising the apparatus for displaying lens contour according to claim 3 and apparatus for processing lens contour data of claim 8.

13. An apparatus for grinding edge of eyeglass lens comprising the apparatus for displaying lens contour according to claim 5 and apparatus for processing lens contour data of claim 8.

14. An apparatus for grinding edge of eyeglass lens comprising the apparatus for displaying lens contour according to claim 6 and apparatus for processing lens contour data of claim 8.

15. An apparatus for processing lens contour data, said apparatus comprising:

lens rim contour data input means for inputting lens rim contour data of an eyeglass frame in three dimensions;

an edge thickness contour data input means for inputting lens rim contour data of an eyeglass frame in three dimensions;

an edge thickness contour data input means for inputting an edge thickness contour data of eyeglass lens to be assembled in a lens rim;

a V-shaped figure data input means for inputting a V-shaped figure data related to V-shaped figure formed in an edge end surface of the eyeglass lens; and a calculating means for setting, as a reference line of a desired incline direction, a straight line perpendicular to line which connect any edge position of the lens rim with an edge position having a relation of point symmetry to a pupil center of the eyeglass wearer's eye for the edge position, obtaining a V-shaped figure data for correction formed in the edge end surface of the eyeglass inclined desirably with the reference line in the center.

16. An apparatus for grinding edge of eyeglass lens comprising the apparatus for processing the lens contour data according to the claim 15 and an apparatus for displaying lens contour data, wherein said apparatus displays a line connecting any edge position of the lens rim with an edge position having a relation of point symmetry to a pupil center of an eyeglass wearer's eye for the edge position to overlap in the lens rim contour.

* * * * *